US006716567B2

(12) United States Patent
Endo et al.

(10) Patent No.: US 6,716,567 B2
(45) Date of Patent: Apr. 6, 2004

(54) SUPPORTING BODY FOR LITHOGRAPHY BLOCK AND ORIGINAL LITHOGRAPHY BLOCK

(75) Inventors: Tadashi Endo, Shizuoka (JP); Hisashi Hotta, Shizuoka (JP); Katsuyuki Teraoka, Shizuoka (JP); Hideki Miwa, Shizuoka (JP); Teruyoshi Yasutake, Shizuoka (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 65 days.

(21) Appl. No.: 10/181,733

(22) PCT Filed: Oct. 26, 2001

(86) PCT No.: PCT/JP01/09441

§ 371 (c)(1),
(2), (4) Date: Jul. 22, 2002

(87) PCT Pub. No.: WO02/34544

PCT Pub. Date: May 2, 2002

(65) Prior Publication Data

US 2003/0145748 A1 Aug. 7, 2003

(30) Foreign Application Priority Data

| | | |
|---|---|---|
| Oct. 26, 2000 | (JP) | 2000-326978 |
| Dec. 26, 2000 | (JP) | 2000-395007 |
| Mar. 15, 2001 | (JP) | 2001-074171 |
| Mar. 16, 2001 | (JP) | 2001-076222 |

(51) Int. Cl.[7] ..... G03C 1/76

(52) U.S. Cl. ..... 430/278.1; 430/270.1; 430/302; 101/453; 101/459

(58) Field of Search ..... 430/270.1, 275.1, 430/278.1, 302, 944, 945; 101/453, 458, 459

(56) References Cited

U.S. PATENT DOCUMENTS

| | | | | |
|---|---|---|---|---|
| 2002/0039702 A1 * | 4/2002 | Hotta | ..... | 430/273.1 |
| 2003/0148207 A1 * | 8/2003 | Maemoto et al | ..... | 430/138 |
| 2003/0165768 A1 * | 9/2003 | Hotta et al. | ..... | 430/146 |

* cited by examiner

*Primary Examiner*—Mark F. Huff
*Assistant Examiner*—Barbara Gilliam
(74) *Attorney, Agent, or Firm*—Burns, Doane, Swecker & Mathis, L.L.P.

(57) ABSTRACT

Objects of the present invention are to provide a positive working presensitized plate of a thermal type, which has damage resistance, and which is handled easily in conventional operation, high in sensitivity and excellent in press life when used as a lithographic printing plate, and to provide a support for a lithographic printing plate, which is suitably used for the same. The objects have been achieved by a support for a lithographic printing plate obtained by performing graining treatment, alkali etching treatment and anodizing treatment on an aluminum plate, wherein a ratio of a real area of a surface thereof to an apparent area of the surface set larger by 1.3 to 1.8 times, comprising a pit having an average diameter of 0.3 to 1.0 $\mu$m and a micro grained structure inside on the surface, wherein a ratio of an apparent area of the pits to the apparent area of the surface is 90% or more; and a presensitized plate comprising the support for a lithographic printing plate and a photosensitive layer that can become alkali-soluble by heating provided on the support.

8 Claims, 3 Drawing Sheets

SUPPORTING BODY FOR LITHOGRAPHY BLOCK AND ORIGINAL LITHOGRAPHY BLOCK

TECHNICAL FIELD

The present invention relates to a support for a lithographic printing plate and a presensitized plate. More particularly, the invention relates to a positive working presensitized plate having a photosensitive layer that can become alkali-soluble by photothermal conversion by a laser beam, and a support for a lithographic printing plate used for the same.

BACKGROUND ART

With development of image formation technology in recent years, it has come to be possible to perform direct plate making by scanning narrow focused laser beams on the printing plate to form a manuscript of letters, images and the like directly on the plate without using a film manuscript.

In a presensitized plate of a so-called thermal positive working type for causing photothermal conversion in a photosensitive layer by laser beam irradiation to make the photosensitive layer alkali soluble, and thus forming a positive image, a subtle change in interaction of binder molecules contained in the photosensitive layer by laser beam exposure is utilized as an image forming principle. Accordingly, a difference in ON/OFF levels of alkaline solubility between exposed and unexposed portions is reduced. Therefore, for the purpose of obtaining clear discrimination to be put to practical use, use has been made of means for forming a photosensitive layer structure by providing a surface slightly soluble layer in developer as an uppermost layer of the photosensitive layer, and suppressing developer solubility of the unexposed portion.

However, when the surface slightly soluble layer is damaged for some reason, even a portion intended as an image area is made easily soluble in the developer. In other words, a printing plate produced is damaged very easily from a practical standpoint. Thus, scratch-shaped non-image portion is brought about by subtle contacts such as clashing in handling of the printing plate, subtle rubbing of an interleaving sheet, contact of fingers with the plate surface or the like.

For example, in the presensitized plate, paper called an interleaving sheet for protecting the plate surface is normally provided on the surface of the photosensitive layer. This interleaving sheet is electrostatically adsorbed on the plate surface, thereby becoming difficult to be peeled off. At present, automatic feeding of the presensitized plate by a machine is generally carried out, and the interleaving sheet adsorbed on the plate surface is also removed mechanically. In this case, however, friction between the interleaving sheet and the photosensitive layer may cause scratching.

Therefore, the above-described presensitized plate of the thermal positive working type is still difficult to be handled in printing plate work. For the purpose of improving the tendency to be damaged, a layer of fluorine-containing surfactant or wax agent has been provided on the surface of the photosensitive layer to reduce a friction coefficient. However, no satisfactory measures have been taken.

Furthermore, the above-described scratch-like non-image portion caused by contact or the like has also been a problem even in the case of a presensitized plate provided with a photosensitive layer which doesn't have a surface slightly soluble layer.

DISCLOSURE OF THE INVENTION

Objects of the present invention are to provide a positive working presensitized plate of a thermal type, which has damage resistance, and which is handled easily in conventional operation, high in sensitivity and excellent in press life when used as a lithographic printing plate, and to provide a support for a lithographic printing plate, which is suitably used for the same.

The inventors conducted serious studies in order to achieve the foregoing objects, and accordingly completed a support for a lithographic printing plate of a first aspect of the present invention.

That is, the first aspect of the present invention provides a support for a lithographic printing plate obtained by performing graining treatment, alkali etching treatment and anodizing treatment on an aluminum plate, wherein a ratio of a real area of a surface thereof to an apparent area of the surface set larger by 1.3 to 1.8 times, comprising a pit having an average diameter of 0.3 to 1.0 $\mu$m and a micro grained structure inside (also referred to as "grained structure with small undulation" hereinafter) on the surface, wherein a ratio of an apparent area of the pits to the apparent area of the surface is 90% or more.

In this case, "ratio of a real area of a surface thereof to an apparent area of the surface" means a value obtained by dividing a real area of a surface of the support for the lithographic printing plate by an apparent area of the surface, wherein the real area of the surface includes a pit surface area but not a surface area of the pit micro grained structure, while the apparent area represented by an area of a drawing of projecting the surface of the support for the lithographic printing plate on a surface parallel to the support. Specifically, when a surface shape of the support for the lithographic printing plate is measured by using an atomic force microscope (AFM) under conditions of horizontal (X, Y) resolution 0.1 $\mu$m, and a measuring area of 100 $\mu$m-square, a surface area obtained by an approximate three-point method is set as a real area, an upper projected area is set as an apparent area and, then, it can be obtained by dividing the real area with the apparent area.

Moreover, "ratio of an apparent area of the pits to the apparent area of the surface" means a value obtained by dividing a pit apparent area represented by an area of a drawing projecting the pits on the surface of the support for the lithographic printing plate on a surface parallel to the support with a surface apparent area of the support for the lithographic printing plate.

Roughness caused by asperities on the support surface is present on a photosensitive layer surface of a positive working presensitized plate of a thermal type. When the photosensitive layer is brought into contact with an object or the like, if the surface of the photosensitive layer is rubbed by the object or the like, a top part of a micro convex portion is slightly rubbed off, fracturing a surface slightly soluble layer, and even the support may be partially exposed. In development, developer easily infiltrates an interface between the support and the photosensitive layer from the fractured portion of the surface slightly soluble layer. Accordingly, the photosensitive layer starts dissolving from near the interface with the support. In other words, development is started preferentially from the rubbed place. Thus, a scratched portion is observed as a white line from a macroscopic standpoint.

The inventors obtained the foregoing knowledge as a result of serious studies. The inventors conducted further serious studies on measures to reduce a level of fine asperities on the surface of the photosensitive layer. As a result, it was discovered that a surface asperity shape on the surface of the support itself decided fine asperities on the surface of the photosensitive. It was also discovered that it was possible to reduce the level of fine asperities on the photosensitive layer surface without deteriorating press life thereof or the like by setting a ratio of a real area to a apparent area of the surface of the support in a specified range, specifying a pit structure, and setting a ratio of a pit apparent area to the surface apparent area in a specified range. Accordingly, the support for the lithographic printing plate capable of forming a photosensitive layer which has damage resistance was realized.

That is, an effective way to realize a flat photosensitive layer surface is to make a surface shape of the support flat as much as possible. However, since adhesion is lowered between the photosensitive layer and the support if the surface shape of the support is made simply flat, press life of the lithographic printing plate is deteriorated, peeling easily occurs between the photosensitive layer and the support, and damaged easily even in printing plate work. On the other hand, if a contact area between the photosensitive layer and the support is only increased simply by mechanical graining treatment or the like in order to increase adhesion between the photosensitive layer and the support, asperities are formed on the photosensitive layer surface, therefore, the photosensitive layer is damaged easily.

According to the present invention, adhesive is secured between the photosensitive layer and the support by setting the ratio of the real area to the apparent area of the surface of the support larger by 1.3 to 1.8 times. To form a smooth shape of the surface of the photosensitive layer while maintaining the ratio, the pit having the average diameter of 0.3 to 1.0 $\mu$m, and the micro grained structure inside is provided on the surface and the ratio of the pit apparent area to the surface apparent area is set to 90% or more. Thus, it is possible to provide both press life or the like and damage resistance for the lithographic printing plate.

Preferably, the support for the lithographic printing plate has a large-medium-small complex grained structure with 3 different frequency undulations and the large grained structure (also referred to "grained structure with large undulation" hereinafter) has a wavelength of 3 to 10 $\mu$m, the medium grained structure (also referred to as "grained structure with medium undulation" hereinafter) is the pit, and the small grained structure is the pit micro grained structure. With such a structure, the press life and water receptivity of the lithographic printing plate become more preferable.

The inventors also discovered scratches does not occur easily by forming a shape of the surface of the support in the following manner. That is, in order to increase a surface area of the support so as to secure adhesion between the photosensitive layer and the support while reducing asperities to make smooth the surface of the photosensitive layer, the surface of the support is provided with a grained structure with large undulation having a wavelength of 2 to 10 $\mu$m, and a grained structure with medium undulation consisting of pits having an average diameter of 0.05 to 0.5 $\mu$m by performing electrochemical graining treatment by alternating current electrolysis using electrolyte containing hydrochloric acid at 100 C/dm$^2$ or lower of a quantity of electricity when the aluminum plate was at an anode side. Thus, a support for a lithographic plate according to a second aspect of the present invention was completed.

That is, the second aspect of the present invention provides a support for a lithographic printing plate obtained by performing graining treatment and anodizing treatment on an aluminum plate, comprising a grained structure with large undulation having a wavelength of 2 to 10 $\mu$m and a grained structure with medium undulation consisting of pits, each having an average diameter of 0.05 to 0.5 $\mu$m on a surface thereof, wherein the grained structure with medium undulation is obtained by performing electrochemical graining treatment by alternating current electrolysis using electrolyte containing hydrochloric acid at 100 C/dm$^2$ or lower of a quantity of electricity when the aluminum plate was at an anode side, and chemical etching treatment to set a quantity of dissolved aluminum to 0.05 to 0.5 g/m$^2$.

In the support for the lithographic printing plate thus constructed, when a photosensitive layer of a thermal positive working type is provided, a presensitized plate is realized, having limited asperities on a smooth surface of the photosensitive layer, a large surface area of the support. Accordingly, the presensitized plate is not damaged easily, excellent in printing performance, and handling is easy in conventional operation.

According to the present invention, preferably, the grained structure with medium undulation is obtained by carrying out chemical etching to set the quantity of dissolved aluminum to 0.05 to 0.5 g/m$^2$ after the electrochemical graining treatment. The grained structure with medium undulation thus obtained by carrying out the chemical etching makes the surface of the support smoother, therefore the surface of the photosensitive layer smoother.

The inventors discovered that in order to secure adhesion between the photosensitive layer and the support by increasing a surface area of the support while reducing asperities to make smooth the surface of the photosensitive layer, by forming a shape of a large-medium-small complex grained structure consisting of 3 different frequency undulations, which has a grained structure with large undulation having a wavelength of 2 to 10 $\mu$m, a grained structure with medium undulation consisting of pits having an average diameter of 0.1 to 1.5 $\mu$m, and a grained structure with small undulation consisting of a micro grained structure inside a pit, scratches do not occur easily.

Further, only with the foregoing structure, it is difficult to remove the photosensitive layer having entered the micro grained structure inside the pits constituting the grained structure with small undulation. Thus, in order to compensate for this, developing performance (sensitivity) must be improved.

The inventors discovered that on the surface of the support having the shape of the above-described large-medium-small complex grained structure consisting of 3 different frequency undulations, by setting an average pore diameter and an average pore density on the anodized layer in specified ranges smaller than normal, it was possible to reduce the quantity of the photosensitive layer entering micropores and to prevent a reduction in an infiltration speed of the entire photosensitive layer caused by infiltration of developer into the micropores. Accordingly, the inventors discovered that it was possible to realize a presensitized plate, which has damage resistance, is high in sensitivity, and high in printing performance. Thus, a support for a lithographic printing plate according to a third aspect of the present invention was completed.

That is, the third aspect of the present invention provides a support for a lithographic printing plate obtained by performing graining treatment, alkali etching treatment and anodizing treatment on an aluminum plate, comprising a grained structure with large undulation having a wavelength of 2 to 10 μm, a grained structure with medium undulation consisting of pits, each having an average diameter of 0.1 to 1.5 μm and a grained structure with small undulation consisting of a micro grained structure inside a pit on a surface thereof, and with regard to an anodized layer formed by the anodizing treatment, an average pore diameter of micropores is 0 to 15 nm, and an average pore density is 0 to 400 pieces/$\mu m^2$.

The present invention also provides a presensitized plate comprising each of the supports for a lithographic printing plate according and a photosensitive layer that can become alkali-soluble by heating provided on the support. Since the presensitized plate of the present invention uses the support for the lithographic printing plate of the present invention, compared with the conventional positive working presensitized plate of the thermal type, it has better damage resistance, higher sensitivity, and better press life or the like when it is processed into a lithographic printing plate.

As described above, according to the present invention, it is possible to greatly improve tendency to be damaged, which has been a problem inherent in the presensitized plate of the thermal positive working type.

BEST MODE FOR CARRYING OUT THE INVENTION

Figure 1:
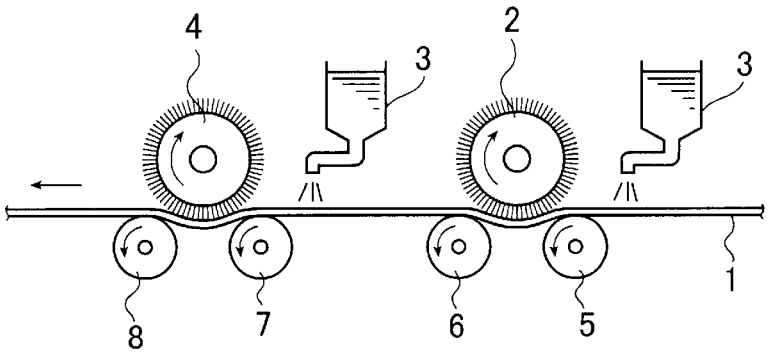
FIG. 1 is a side view showing a concept of a brush graining process used for mechanical graining in preparation of a support for a lithographic printing plate of the present invention.

The present invention is described below in detail.

A Support for a Lithographic Printing Plate

Aluminum Plate (Rolled Aluminum)

An aluminum plate used for a support for a lithographic printing plate of the present invention is metal having dimensional stable aluminum as the main component and are composed of aluminum or aluminum alloy. Besides a pure aluminum plate, alloy with aluminum as the main component containing very small quantity of different elements, plastic film or paper laminated or vapor deposited with aluminum or aluminum alloy may be used. Further, as described in JP 48-18327 B (the term "JP XX-XXXXXX B" as used herein means an "examined Japanese patent publication"), a composite sheet in which an aluminum sheet is combined on a polyethylene terephthalate film may be used.

Hereinafter, various plates composed of aluminum or aluminum alloy described before are referred to as an aluminum plate as a generic name. Different elements that may be contained in the aluminum alloy are silicon, iron, manganese, copper, magnesium, chromium, zinc, bismuth, nickel, titanium and so on. The content in the aluminum alloy is 10 wt % or less.

A pure aluminum plate is preferably used in the present invention, but since it is difficult to produce perfectly pure aluminum from the viewpoint of refining technology, aluminum containing tiny quantity of different elements may be allowable. Composition of the aluminum plate used in the present invention is not specified in this way and materials well-known before such as JIS A1050, JIS A1100, JIS A3005, JIS A3004, International registered alloy 3103A and the like may be used as occasion arises. With regard to a production method of an aluminum plate, continuous casting and DC casting can be used, and also an aluminum plate produced without an annealing process and soaking in the DC casting can be used. The aluminum plate having asperity by laminated rolling or transcription in the final rolling process may be used. Thickness of aluminum plates used in the present invention is around 0.1 to 0.6 mm. This thickness may be changed depending on size of a printing machine, size of a printing plate and user requires.

The support for a lithographic printing plate of the present invention is obtained by performing graining treatment, chemical etching treatment (in particular alkali etching treatment) and anodizing treatment on the aluminum plate. Other various processes besides the graining treatment, chemical etching treatment (in particular alkali etching treatment) and anodizing treatment may be included in the production process of the support.

Surface Roughing Treatment (Graining Treatment)

The foregoing aluminum plate has a preferable shape by performing graining treatment. As a graining treatment method, there is mechanical graining as described in JP 56-28893 A (the term "JP XX-XXXXXX A" as used herein means an "unexamined published Japanese patent application"), chemical etching, electrolytic graining and the like. Furthermore, an electrochemical graining (electrolytic graining) method graining a surface of aluminum in hydrochloric acid electrolytic solution or nitric acid electrolytic solution electrochemically, a mechanical graining method such as a wire brushing graining method scratching a surface of aluminum with metal wire, a ball graining method graining a surface of aluminum with abrasives and a graining ball, a brush graining method graining the surface with nylon brushes and abrasives and the like, may be used. These graining methods may be used alone or in combination of those such as combination of mechanical graining with nylon brushes and abrasives and combination of multiple electrolytic graining treatments.

Particularly, since the electroytic graining, in particular, electroytic graining using electoryte containing hydrochloric acid, after mechanical graining can easily make complex grained structure comprising 2 different frequency undulations of large and medium undulations described after on the surface of the support for a lithographic printing plate, it is preferable.

In the case of a brush graining method, by selecting properly conditions such as an average diameter of particles used as an abrasive, the maximum diameter of the particles, diameters of bristles of the brush, density of the bristles, pressing pressure and the like, it is possible to control an average depth of concave portions in long wavelength components (large undulation) on the surface of a support for a lithographic printing plate. At the concave portions obtained by the brush graining method, the average wavelength is preferably 2 to 1 μm, more preferably 3 to 10 μm and average depth is preferably 0.2 to 1 μm, more preferably 0.3 to 1 μm. Among those graining methods, a preferable method for making a grained surface used in the present invention is an electrochemical method graining the surface chemically in the hydrochloric acid electrolytic solution or nitric acid electrolytic solution. Preferable current density is 50 to 400 C/dm$^2$ at an anode electricity quantity. Further concretely, for example, it is carried out in electrolytic solution containing hydrochloric acid or nitric acid of 0.1 to 50 wt % under such conditions as at 20 to 100° C. of temperature, 1 second to 30 minutes of time and 100 to 400 C/dm$^2$ of current density, using direct current or alternating current. Since the electrochemical graining can easily process pits on the surface, it can improve adhesion between the photosensitive layers and the support.

In accordance with a second aspect of the present invention, as an electrochemical graining method, an electrochemical method for graining the surface chemically by using alternating current in hydrochloric acid electrolyte is used. In this case, an anode electricity quantity is 100 C/dm$^2$ or lower, preferably 80 C/dm$^2$ or lower. Preferably, an anode electricity quantity is 10 C/dm$^2$ or higher.

Concretely, for example, it is carried out in electrolyte containing hydrochloric acid of 0.1 to 50 wt % under such conditions as at 20 to 100° C. of temperature, 1 second to 30 minutes of time, and 40 A/dm$^2$ or lower of anode current density, using alternating current. Since the electrolytic graining treatment can easily process fine asperities (pits) on the surface, it is possible to improve adhesion between the photosensitive layer and the support.

Moreover, in the second aspect of the present invention, in combination with the electrochemical graining treatment using the electrolyte containing the hydrochloric acid, it is also possible to carry out electrochemical graining treatment using electrolyte containing nitric acid under general processing conditions.

By electrolytic graining treatment after mechanical graining treatment, crater-shaped or honeycomb-shaped pits of desired sizes, described later, are formed on the surface of the aluminum plate at an area rate of 80 to 100%, preferably 90 to 100%, thereby forming of large-and-medium complex grained structure comprising 2 different frequency undulations. That is, the mechanical graining treatment forms a large undulation structure having an average waveform of 2 to 10 $\mu$m, preferably 3 to 10 $\mu$m. The electrolytic graining treatment such as electrolytic graining treatment using electrolyte containing hydrochloric acid or nitric acid forms a pit, i.e., a medium undulation structure.

In the first aspect, a desired size of a pit has an average diameter of about 0.3 to 1.0 $\mu$m, and an average depth of 0.05 to 4 $\mu$m. In the second aspect, a desired size has an average diameter of 0.05 to 0.5 $\mu$m, and an average depth of 0.01 to 0.6 $\mu$m. In a third aspect, a desired size has an average diameter of 0.1 to 1.5 $\mu$m, and an average depth of 0.05 to 0.4 $\mu$m.

In the case of carrying out only the electrolytic graining treatment without carrying out any mechanical graining treatments, preferably, an average depth of pits is set to be less than 0.3 $\mu$m. For example, by carrying out electrolytic graining treatment twice or more preferably changing conditions without carrying out any mechanical graining treatments, it is possible to form a complex grained structure comprising of 2 different frequency undulations consisting of large undulation having average wavelengths set at 2 to 10 $\mu$m, preferably 3 to 10 $\mu$m, and medium undulation of pits.

The pits formed have functions to improve scum resistance and press life of the non-image areas of the printing plates. In the electrolytic graining treatment, the quantity of electricity, that is, the product of electric current and running time for the current, which is required for forming adequate pits on the surface, is an important condition. It is desirable to form adequate pits by less amount of electricity from a viewpoint of energy saving.

Surface roughness after the graining treatment is preferably 0.2 to 0.6 $\mu$m, more preferably 0.2 to 0.5 $\mu$m at the arithmetical mean roughness ($R_a$) measured at 0.8 mm of cut-off value, 3.0 mm of evaluation length in accordance with JIS B0601-1994.

In the first aspect of the present invention, the aluminum plate subjected to the graining treatment in the above-describe manner has a real area of the surface larger by 1.3 to 1.8 times than an apparent area. This ratio is not changed even after the alkali etching treatment and the anodizing treatment is performed.

Chemical Etching Treatment

It is preferable that chemical etching is performed on a graining-treated aluminum plate in the above-described manner. As the chemical etching, etching with an acid and etching with an alkali are known. As an especially excellent method in terms of etching efficiency, a chemical etching (alkali etching) using an alkali solution is enumerated.

An alkali agent used suitably in the present invention includes sodium hydroxide, sodium carbonate, sodium aluminate, sodium metasilicate, sodium phosphate, potassium hydroxide, lithium hydroxide but not limited to these.

The alkali etching is preferably performed in the condition that dissolving amount of Al is 0.05 to 0.5 g/m$^2$ As other conditions are also not limited, alkali concentration is preferably 1 to 50 wt %, more preferably 5 to 30 wt % and alkali temperature is preferably 20 to 100° C., more preferably 30 to 50° C.

The alkali etching is not limited to one method but combination of multiple methods may be used.

Then, in this invention, alkali etching may be performed after mechanical graining and before electrochemical graining. In this case dissolving amount of Al is preferably 0.05 to 30 g/m$^2$.

After the alkali etching treatment, washing (desmutting treatment) with acid is carried out to remove smut remained on the surface. Acid to be used includes, for example, nitric acid, sulfuric acid, phosphoric acid, chromic acid, hydrofluoric acid and borofluoric acid. In particular, as a method for removing smut after electrolytic graining treatment, the method in which smut is made contact to sulfuric acid of 15 to 65 wt % at 50 to 90° C. of temperature, as described in JP 53-12739 A is preferable.

Also, when chemical etching treatment is performed in an acid solution, as acid used for the acid solution are enumerated, for example, sulfuric acid, nitric acid, hydrochloric acid but it is not limited to those.

Concentration of the acid solution is preferably 1 to 50 wt %.

In addition, temperature of the acid solution is preferably 20 to 80° C.

The chemical etching treatment enables an average diameter of the pits to be controlled to the above-described desired size as well as a micro grained structure to be formed inside the pits. Micro grained structure is indefinite in form, and a circle equivalent diameter (area circle equivalent diameter) thereof can be set to, for example 0.005 to 0.1 $\mu$m.

Thus, when the medium undulation structure is formed by the graining treatment, the alkali etching treatment forms the micro grained structure, thereby forming a complex grained structure comprising 2 different frequency undulations consisting of medium undulation and small undulation. Then, when the complex grained structure comprising 2 different frequency undulations consisting of large undulation and medium undulation is formed by the graining treatment, the alkali etching treatment forms the micro grained structure, thereby forming a complex grained structure comprising 3 different frequency undulations consisting of large undulation, medium undulation and small undulation.

Anodizing Treatment

Anodizing treatment is performed on an aluminum plate treated as described above. With regard to the anodizing treatment, methods that have been conventionally used in this field can be used. Specifically, when direct current or alternating current is fed to the aluminum plates in aqueous solution or non aqueous solution, alone or in combination, of sulfuric acid, phosphoric acid, chromic acid, oxalic acid, sulfamic acid, benzene-sulfonic acid and the like, an anodized layer can be formed on the surface of the aluminum plate.

In this case, even if any ingredient contained in Al alloy plate, electrode, city water, underground water and the like is contained in the electrolytic solution, there is no problem. Further, containing of the second and third ingredients is also allowable. The second and third ingredients herein include ion of metal such as Na, K, Mg, Li, Ca, Ti, Al, V, Cr, Mn, Fe, Co, Ni, Cu, Zn and the like; cation such as ammonium ion; anion such as nitric acid ion, carbonic acid ion, chloride ion, phosphoric acid ion, fluoride ion, sulfurous acid ion, titanic acid ion, silicic acid ion and boric acid ion. Containing 0 to 10000 ppm of those ions is allowable.

Since conditions for anodizing treatment change variously depending on the electrolytic solution being used, those are not decided unconditionally, but it is generally appropriate that concentration of electrolytic solution is 1 to 80 wt %, temperature of solution is −5 to 70° C., current density is 0.5 to 60 A/dm$^2$, voltage is 1 to 100 V, time for electrolysis is 10 to 200 seconds.

Among these anodizing treatment methods, the method in which anodizing is carried out in sulfuric acid electrolytic solution with high current density, described in GB 1,412,768 B, is particularly preferable. In the present invention, quantity of the anodized layers is preferably 1 to 10 g/m$^2$. If it is less than 1 g/m$^2$, plates are scratched easily. And if it is more than 10 g/m$^2$, much quantity of electricity is needed for the production, which is economically disadvantaged. Quantity of the anodized layers is preferably 1.5 to 7 g/m , more preferably 2 to 5 g/m$^2$.

Here, it is preferable that an average pore diameter of micropore is 0 to 15 nm, and an average pore density is 0 to 400 pieces/$\mu$m$^2$ in the anodized layer in order to suppress the sensitivity deterioration attributed by the micropores. That is, in the support for the lithographic printing plate of the present invention, it does not matter whether the anodized layer has the micropores or not. When the anodized layer has the micropores, it is preferable that the average pore diameter thereof is 15 nm or less, and the average pore density is 400 pieces/$\mu$m$^2$ or less. It is more preferable that the anodized layer is not provided with the micropores, which shows better sensibility.

Treatment with Alkali Metal Silicate

The support for a lithographic printing plate obtained by forming the anodized layer described above is performed immersing treatment in alkali metal silicate water solution as required.

Conditions of the treatment are not particularly limited, and for example the immersing treatment may be performed by using the water solution having concentration of 0.01 to 5.0 wt %, at 5 to 40° C. for 1 to 60 seconds. After that, it may be rinsed by flowing water. Temperature of the immersing treatment is more preferably 10 to 40° C. and immersing time is more preferably 2 to 20 seconds.

Alkali metal silicate used in the present invention includes, for example, sodium silicate, potassium silicate, and lithium silicate.

Alkali metal silicate water solution may contain sodium hydroxide, potassium hydroxide, lithium hydroxide or the like in adequate amount.

Further, alkali metal silicate water solution may contain alkaline earth metal salt and/or the group 4 (IVA) metal salt. As the alkaline earth metal salt, for example, nitrate such as calcium nitrate, strontium nitrate, magnesium nitrate, barium nitrate or the like; sulfate; chloride; phosphate; acetate; oxalate; borate are included. As the group 4 (IVA) metal salt, for example, titanium tetrachloride, titanium trichloride, titanium potassium fluoride, titanium potassium oxalate, titanium sulfate, titanium tetraiodide, zirconium chloride oxide, zirconium dioxide, zirconium oxychloride, zirconium tetrachloride are included. Alkaline earth metal salt and the group 4 (IVA) metal salt described above may be used alone or in combination of 2 or more.

Si quantity adsorbed by the treatment with alkali metal silicate is measured with a fluorescent X-ray analyzer and the quantity is preferably about 1.0 to 15.0 mg/m$^2$.

Solubility resistance of the surface of the support for a lithographic printing plate to the alkali developer can be improved by this treatment with alkali metal silicate to restrain elution of aluminum components into the developer and to decrease generation of development residue caused by developer exhaustion.

Sealing Treatment

After the anodizing treatment, sealing treatment may be carried out if desired. The sealing treatment is carried out by a method of dipping the anodized support in hot water solution containing hot water or inorganic or organic salt, a method of exposing the support to steam bath or the like. Concretely, for example, sealing treatments by pressurized steam or hot water described in JP 4-176690 A, and JP 11-301135 A can be enumerated.

In the support for the lithographic printing plate of the present invention, in the case of sealing treatment is performed, preferably, an average pore diameter of micropores is 0 to 15 nm, and an average pore density is 0 to 400 pieces/$\mu$m$^2$ in the anodized layer after the sealing treatment. Before the sealing treatment, micropores on the anodized layer need not satisfy these conditions.

Surface Control Processing

After the anodizing treatment, surface control processing such as water wettability treatment may be carried out if desired.

For the surface control processing, other than the above-described alkali metal silicate treatment, a method using zirconic acid potassium fluoride described in JP 36-22063 B, methods using polyvinyl phosphonic acid described in U.S. Pat. Nos. 3,276,868, 4,153,461 and 4,689,272, and the like have been used.

For details of each treatment described in each of the above items, well-known conditions can be employed suitably. Also, the contents of literatures cited herein are incorporated herein by reference.

The support for the lithographic printing plate according to the first aspect of the present invention has a real area of the surface thereof larger by 1.3 to 1.8 times, preferably 1.3 to 1.7 times, more preferably 1.3 to 1.6 times than an apparent area of the surface. Since the ratio of the real area to the apparent area of the surface of the support is larger by 1.3 to 1.8 times, adhesion between the photosensitive layer and the support is high, and accordingly the lithographic printing plate has a long press life or the like.

Further, the support for the lithographic printing plate according to the first aspect of the present invention has pits on its surface, which have an average diameter of 0.3 to 1.0 μm, preferably 0.3 to 0.8 μm, and an average depth of 0.05 to 0.4 μm, preferably 0.05 to 0.3 μm, and a micro grained structure inside preferably having a wavelength of 0.005 to 0.1 μm, more preferably 0.05 to 0.1 μm. Thus, a surface shape of the photosensitive layer becomes smooth when it is processed into the presensitized plate.

In addition, the support for the lithographic printing plate according to the first aspect of the present invention has a ratio of an apparent pit area to an apparent surface area set equal to 90% or more, preferably 95% or more. Accordingly, when it is used as the presensitized plate, adhesion between the photosensitive layer and the support is improved and thus a press life of the lithographic printing plate or the like would be excellent.

Moreover, in the support for the lithographic printing plate according to the first aspect of the invention, preferably, the surface thereof has a large-medium-small complex grained structure consisting of 3 different frequency undulations, a wavelength of the large undulation is 3 to 10 μm, the medium undulation is a pit, and the small undulation has a micro grained structure of pits. This structure improves press life and water receptivity of the lithographic printing plate.

Image Forming Layer

A presensitized plate of the present invention can be obtained by providing photosensitive layer that can become alkali-soluble by heating over the support for a lithographic printing plate of the present invention obtained in the foregoing manner. Preferably, it can be obtained by providing photosensitive layer that can become alkali-soluble by heating after providing an intermediate layer readily soluble in alkali over the support for a lithographic printing plate of the present invention. Following are descriptions on the intermediate layer readily soluble in alkali and the photosensitive layer that can become alkali-soluble by heating.

Intermediate Layer

While the intermediate layer readily soluble in alkali in the presensitized plate of the present invention is not particularly limited as far as it is readily soluble in alkali, it is preferred to contain polymers including monomers having acid groups and it is more preferred to contain polymers with monomers having acid groups and including monomers having onium groups. Note that, the presensitized plate of the present invention includes, besides the one that is constituted of two layers such as an "intermediate layer" and a "photosensitive layer" as described below, the one that is constituted of only one photosensitive layer wherein the alkali solubility of the aluminum support side is higher than that of the surface side.

Details of polymers included in the intermediate layer will be explained below. The polymer included in the intermediate layer is a compound produced by polymerization of monomers having at least one acid group. And preferably, it is a compound produced by polymerization of monomers having acid groups and monomers having onium groups.

The acid groups here used are, preferably, those with acid dissociation constant ($pK_a$) of 7 or less, more preferably, —COOH, —$SO_3H$, —$OSO_3H$, —$PO_3H_2$, —$OPO_3H_2$, —$CONHSO_2$, —$SO_2NHSO_2$—, and particularly —COOH are preferred.

On the other hand, preferred onium groups are those containing any atoms belonging to the group 15 (VB group) or the group 16 (VIB group) in the periodic table, more preferred onium groups are those containing nitrogen atoms, phosphorus atoms or sulfur atoms, and an onium group containing nitrogen atoms is particularly preferred.

Polymers used in the present invention are those polymer compounds characterized in that their main chain structure is preferably a vinyl polymer such as acrylic resin, methacrylic resin or polystyrene, urethane resin, polyester or polyamide. More preferably, the main chain structure is a polymer compound characterized in that it is a vinyl polymer such as acrylic resin, methacrylic resin or polystyrene. Particularly preferred is the polymer compound characterized in that the monomer having an acid group is a compound expressed in the general formula (1) or (2) and the monomer having an onium group is a compound expressed in the general formulas (3), (4) or (5) being described later.

(1)

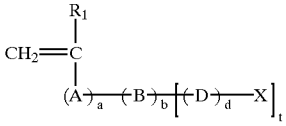

(2)

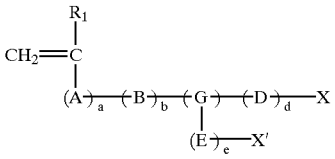

In formulas, A represents a divalent combination group and B represents a divalent aromatic group or a substituted aromatic group. D and E represent independently a divalent combination group respectively. G represents a trivalent combination group. X and X' represent independently an acid group with $pK_a$ of 7 or less, or its alkali metal salt or ammonium salt respectively. $R_1$ represents a hydrogen atom, an alkyl group or a halogen atom. Reference codes a, b, d and e represent independently an integer of 0 or 1 respectively. The reference code t represents an integer of 1–3.

In a monomer having an acid group, preferably, A represents —COO— or —CONH—, and B represents a phenylene group or a substituted phenylene group where the substutuent is a hydroxy group, a halogen atom or an alkyl group. D and E represent independently an alkylene group or a divalent combination group that is expressed with molecular formulas $C_nH_{2n}O$, $C_nH_{2n}S$ or $C_nH_{2+1}N$, respectively. G represents a trivalent combination group that is expressed with molecular formulas $C_nH_{2n-1}$, $C_nH_{2n-1}O$, $CnH_{2n-1}S$ or $C_nH_{2n}N$. Provided, that n represents an integer of 1–12. X and X' represent independently a carboxylic acid, sulfonic acid, phosphonic acid, a sulfuric monoester or a phosphoric monoester phosphorate, respectively. $R_1$ represents a hydrogen atom or an alkyl group. Reference codes a, b, d and e represent independently 0 or 1 respectively, but a and b are not 0 at the same time. In monomers having an acid group, particularly preferable one is a compound expressed with the general formula (1), wherein B represents a phenylene group or a substituted phenylene group where the substituent is a hydroxy group or an alkyl group of 1 to 3 carbon atoms. D and E represent independently an alkylene group of 1 to 2 carbon atoms or an alkylene group of 1 to 2 carbon atoms combined with an oxygen atom respectively. $R_1$ represents a hydrogen atom or an alkyl group. X represents a carboxylic acid. The reference code a is 0, and b is 1.

Concrete examples of monomers having an acid group are shown below. However, the present invention is not limited to these examples.

Concrete Examples of Monomers Having an Acid Group
acrylic acid, methacrylic acid, crotonic acid, isocrotonic acid, itaconic acid, maleic acid, maleic anhydride
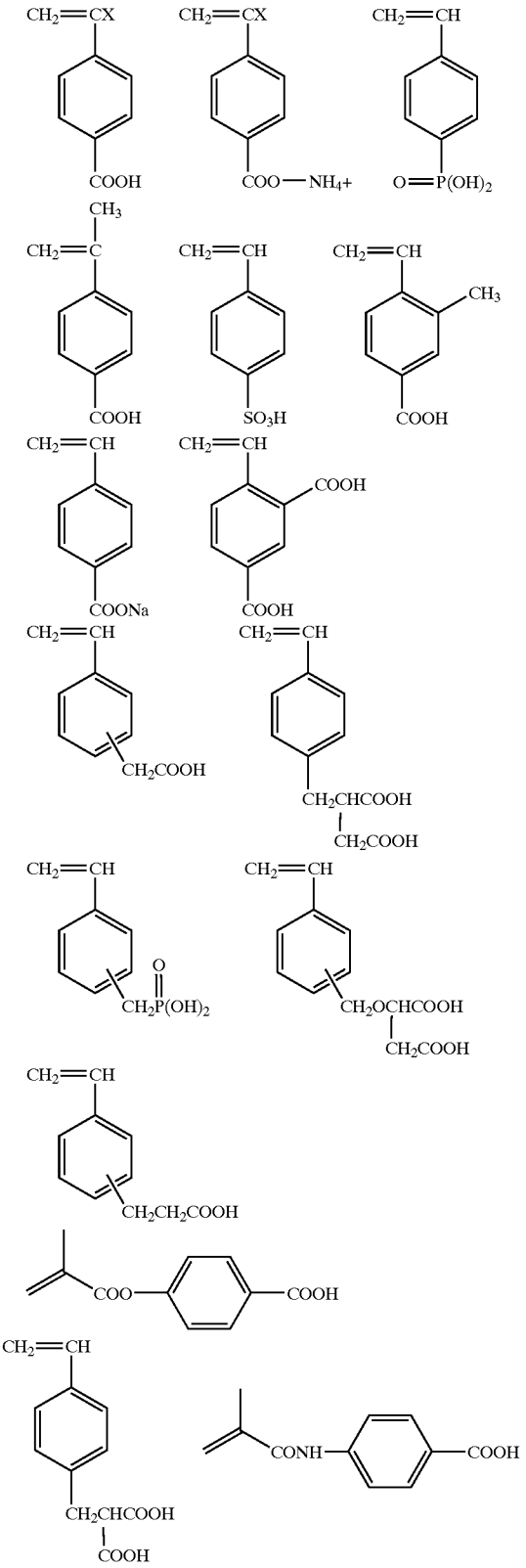
-continued
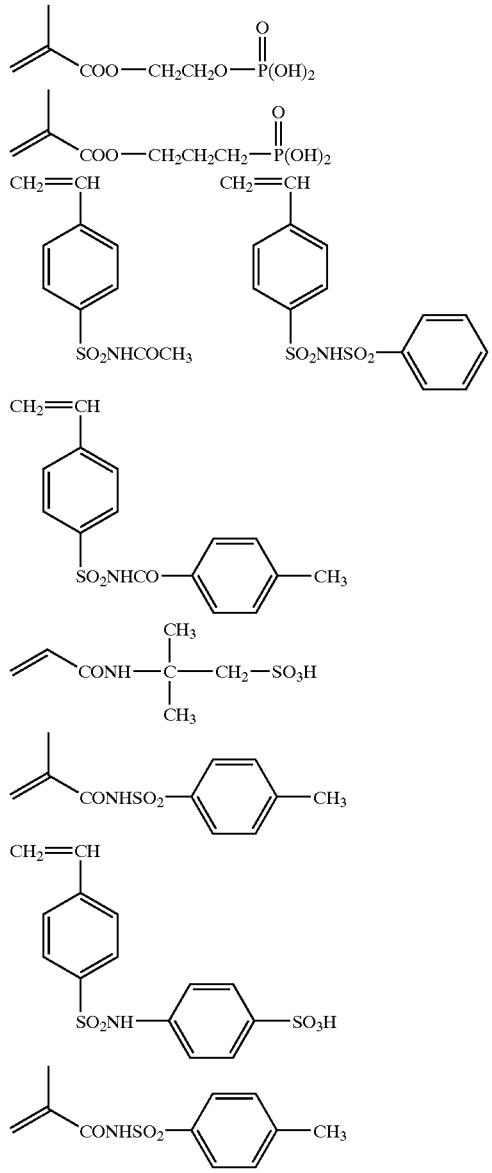
Next, polymers including a monomer having an onium group expressed by one of the following formulas (3), (4) or (5) will be explained.
(3)
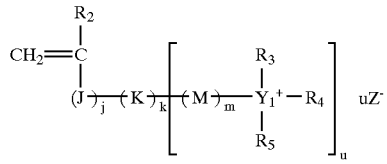
(4)
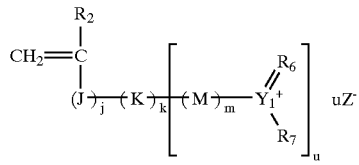

-continued (5)

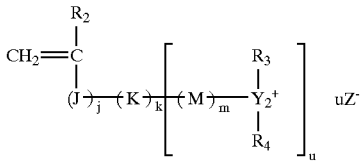

In formulas, J represents a divalent combination group. K represents a divalent aromatic group or a substituted aromatic group. M represents a divalent combination group. $Y_1$ represents an atom of the group 15 (VB group) in the periodic table, and $Y_2$ represents an atom of the group 16 (VIB group) in the periodic table. $Z^-$ represents a counter anion. $R_2$ represents a hydrogen atom, an alkyl group or a halogen atom. $R_3$, $R_4$, $R_5$ and $R_7$ represent independently a hydrogen atom or, an alkyl group, an aromatic group or an aralkyl group that may be bonded with substituents if circumstances require, respectively, and $R_6$ represents an alkylidyne or a substituted alkylidyne, but $R_3$ and $R_4$, and, $R_6$ and $R_7$ may form a ring respectively by bonding to each other. Reference codes j, k and m represent independently 0 or 1 respectively. The reference code u represents an integer of 1–3.

In monomers having onium groups, more preferably, J represents —COO— or —CONH—, and K represents a phenylene group or a substituted phenylene group where the substutuent is a hydroxy group, a halogen atom or an alkyl group. M represents an alkylene group or a divalent combination group that is expressed with molecular formulas $C_nH_{2n}O$, $C_nH_{2n}S$ or $CnH_{2n+1}N$. Provided, that n represents an integer of 1 to 12. $Y_1$ represents a nitrogen atom or a phosphorus atom and $Y_2$ represents a sulfur atom. $Z^-$ represents a halogen ion, $PF_6^-$, $BF_4^-$ or $R_8SO_3^-$. $R_2$ represents a hydrogen atom or an alkyl group. $R_3$, $R_4$, $R_5$ and $R_7$ represent independently a hydrogen atom or, an alkyl group, an aromatic group or an aralkyl group of 1 to 10 carbon atoms that may be bonded with substituents if circumstances require, respectively, and $R_6$ represents an alkylidyne or an substituted alkylidyne of 1 to 10 carbon atoms. $R_3$ and $R_4$, and, $R_6$ and $R_7$ may form a ring respectively by bonding to each other. Reference codes j, k and m represent independently 0 or 1 respectively, however, j and k are not 0 at the same time. $R_8$ represents an alkyl group, an aromatic group or an aralkyl group of 1 to 10 carbon atoms that may be bonded with substituents.

Among monomers having onium groups, more preferably K represents a phenylene group or a substituted phenylene group where the substutuent is a hydrogen atom or an alkyl group of 1 to 3 carbon atoms. M represents an alkylene group of 1 to 2 carbon atoms or an alkylene group of 1 to 2 carbon atoms combined with an oxygen atom. $Z^-$ represents a chlorine ion or $R_8SO_3^-$. $R_2$ represents a hydrogen atom or a methyl group. The reference code j is 0 and k is 1. $R_8$ represents an alkyl group of 1 to 3 carbon atoms.

Concrete examples of the monomers having onium groups are shown below. However, the present invention is not limited to those examples.

Concrete Examples of Monomers Having Onium Groups

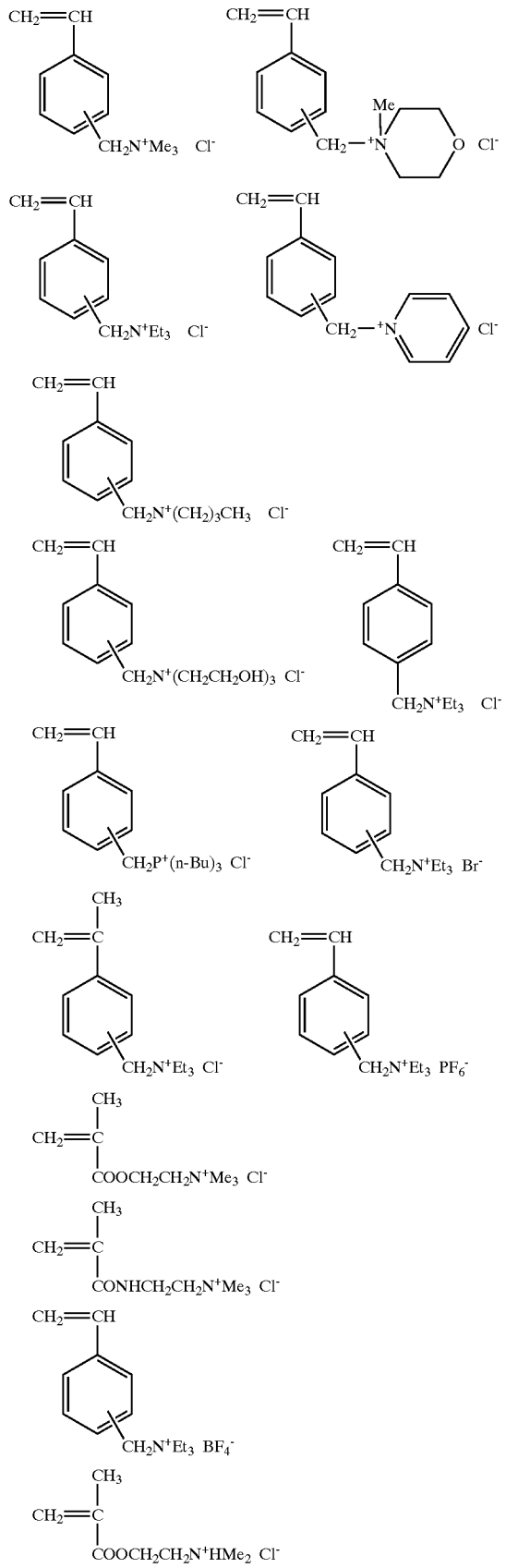

-continued

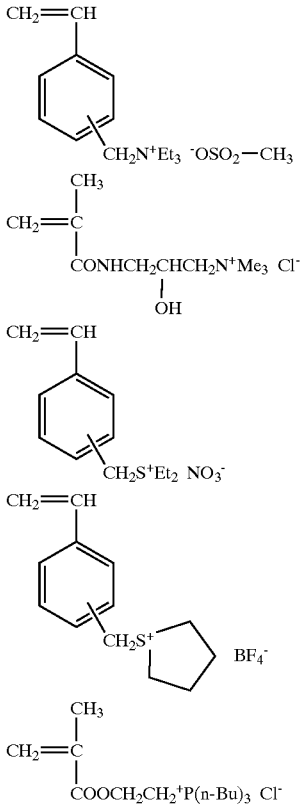

Monomers with acid groups may be used either alone or in a combination of two or more of them, and also, monomers with onium groups may be used either alone or in a combination of two or more of them. Further, polymers used in accordance with the present invention may be used as a mixture of two or more polymers that are different in monomers, the composition ratio or the molecular weight. In this case, the polymer having a monomer with an acid group as a polymerization ingredient has, preferably more than 1 mol %, and more preferably more than 5 mol % of the monomer with an acid group, and also, the polymer having a monomer with an onium group as a polymerization ingredient has, preferably more than 1 mol %, and more preferably more than 5 mol % of the monomer with an onium group.

In addition, these polymers may contain at least one kind of monomers selected from (1)–(14) shown below as a copolymer ingredient.

(1) Acrylamides, methacrylamides, acrylic esters, methacrylic esters metharylates and hydroxystyrenes such as N-(4-hydroxyphenyl) acrylamide, N-(4-hydroxyphenyl) methacrylamide; o-, m- or p-hydroxystyrene, o- or m-bromo-p-hydroxystyrene, o- or m-chloro-p-hydroxystyrene and o-, m- or p-hydroxyphenyl acrylate or methacrylate;

(2) unsaturated carboxylic acids such as acrylic acid, methacrylic acid, maleic acid and maleic anhydride and half ester thereof; itaconic acid and itaconic anhydride and half ester thereof;

(3) acrylamides such as N-(o-aminosulfonyl phenyl) acrylamide, N-(m-aminosulfonyl phenyl) acrylamide, N-(p-aminosulfonyl phenyl) acrylamide, N-[1-(3-aminosulfonyl)naphthyl] acrylamide, N-(2-aminosulfonyl ethyl) acrylamide; methacrylamides such as N-(o-aminosulfonyl phenyl) methacrylamide, N-(m-aminosulfonyl phenyl) methacrylamide, N-(p-aminosulfonyl phenyl) methacrylamide, N-[1-(3-aminosulfonyl)naphthyl] methacrylamide, N-(2-aminosulfonyl ethyl) methacrylamide; also, unsaturated sulfonamides of acrylic esters and the like such as o-aminosulfonyl phenyl acrylate, m-aminosulfonyl phenyl acrylate, p-aminosulfonyl phenyl acrylate, 1-(3-aminosulfonyl phenyl naphthyl) acrylate; unsaturated sulfonamides of methacrylic esters and the like esters such as o-aminosulfonyl phenyl methacrylate, m-aminosulfonyl phenyl methacrylate, p-aminosulfonyl phenyl methacrylate, 1-(3-aminosulfonyl phenyl naphthyl) methacrylate;

(4) phenyl sulfonyl acrylamides that may have a substituent such as tosylacrylamide and phenyl sulfonyl methacrylamides that may have a substituent such as tosylmethacrylamide;

(5) acrylic esters and methacrylic esters that have an aliphatic hydroxy group, for example, 2-hydroxyethyl acrylate or 2-hydroxyethyl methacrylate;

(6) (substituted) acrylic esters acrylates such as methyl acrylate, ethyl acrylate, propyl acrylate, butyl acrylate, amyl acrylate, hexyl acrylate, cyclohexyl acrylate, octyl acrylate, phenyl acrylate, benzyl acrylate, 2-chloroethyl acrylate, 4-hydroxybutyl acrylate, glycidyl acrylate, N-dimethylamino ethyl acrylate;

(7) (substituted) methacrylic esters such as methyl methacrylate, ethyl methacrylate, propyl methacrylate, butyl methacrylate, amyl methacrylate, hexyl methacrylate, cyclohexyl methacrylate, octyl methacrylate, phenyl methacrylate, benzyl methacrylate, 2-chloroethyl methacrylate, 4-hydroxybutyl methacrylate, glycidyl methacrylate, N-dimethylamino ethyl methacrylate;

(8) acrylamides or methacrylamides such as acrylamide, methacrylamide, N-methylol acrylamide, N-methylol methacrylamide, N-ethyl acrylamide, N-ethyl methacrylamide, N-hexyl acrylamide, N-hexyl methacrylamide, N-cyclohexyl acrylamide, N-cyclohexyl methacrylamide, N-hydroxyethyl acrylamide, N-hydroxyethyl methacrylamide, N-phenyl acrylamide, N-phenyl methacrylamide, N-benzyl acrylamide, N-benzyl methacrylamide, N-nitrophenyl acrylamide, N-nitrophenyl methacrylamide, N-ethyl-N-phenyl acrylamide and N-ethyl-N-phenyl methacrylamide;

(9) vinyl ethers such as ethyl vinyl ether, 2-chloroethyl vinyl ether, hydroxyethyl vinyl ether, propyl vinyl ether, butyl vinyl ether, octyl vinyl ether and phenyl vinyl ether;

(10) vinyl esters such as vinyl acetate, vinyl chloroacetate, vinyl butylate and vinyl benzoate;

(11) styrenes such as styrene, α-methyl styrene, methyl styrene and chloromethyl styrene;

(12) vinyl ketones such as methyl vinyl ketone, ethyl vinyl ketone, propyl vinyl ketone and phenyl vinyl ketone;

(13) olefins such as ethylene, propylene, isobutylene, butadiene and isoprene;

(14) N-vinyl pyrrolidone, N-vinyl carbazole, 4-vinyl pyridine, acrylonitrile, methacrylonitrile and the like.

For the polymer used here, the one containing a monomer having an acid group not less than 1 mol % is preferable and the one containing the same not less than 5 mol % is more preferable, and also, the one containing a monomer having an onium group not less than 1 mol % is preferable and the one containing the same not less than 5 mol % is more preferable. In addition, if a monomer having an acid group is contained by 20% or more, the dissolution removal at the time of alkali development is facilitated much more. And if a monomer having an onium group is contained by 1 mol % or more, the adhesion is improved much more owing to the synergistic effect with the acid group. Constitutional ingredients having acid groups may be used either alone or in a combination of two or more of them, and also, monomers with onium groups may be used either alone or in a combination of two or more of them. Further, for polymers used in accordance with the present invention they may be used as a mixture of two or more polymers that are different in monomers, the composition ratio or the molecular weight. Then, typical examples of polymers used in the present invention are shown below. The composition ratios of polymer structures represent mole percentages.

TYPICAL EXAMPLES OF POLYMERS

| | STRUCTURES | NUMBER-AVERAGE MOLECULAR WEIGHT ($M_n$) |
|---|---|---|
| No. 1 | 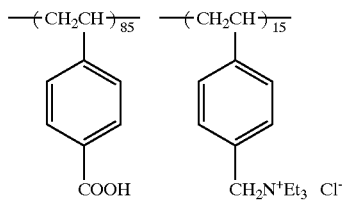 | 2,100 |
| No. 2 | 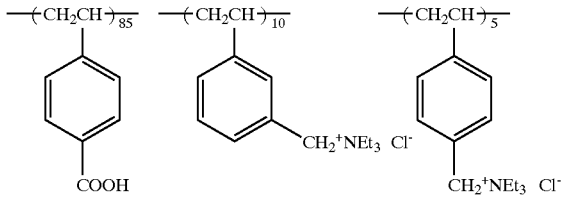 | 4,800 |
| No. 3 | 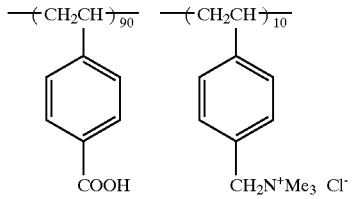 | 3,200 |
| No. 4 | 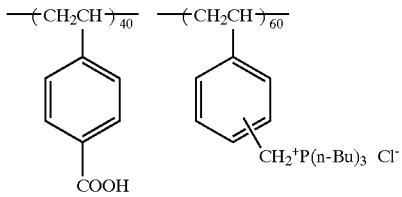 | 2,300 |
| No. 5 | 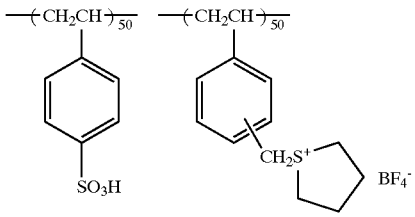 | 1,400 |

-continued
| | | |
|---|---|---|
| No. 6 | 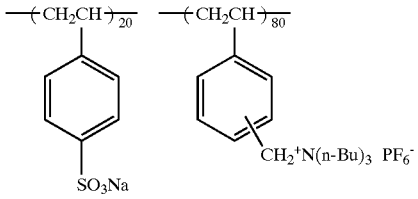 | 4,500 |
| No. 7 | 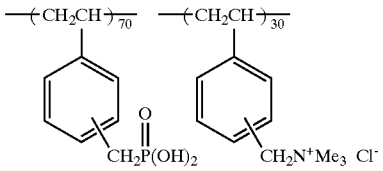 | 5,000 |
| No. 8 | 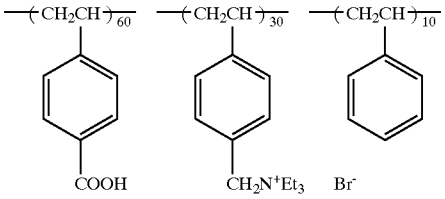 | 1,000 |
| No. 9 | 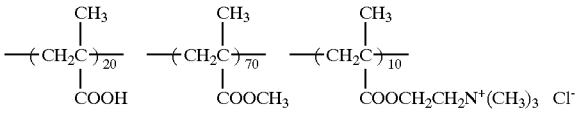 | 1,300 |
| No. 10 | 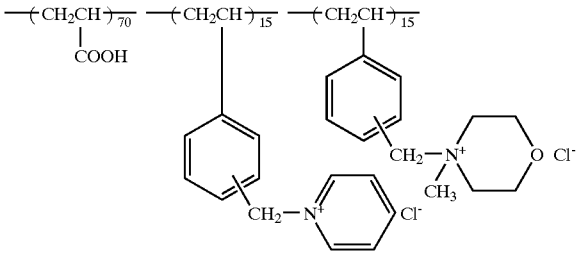 | 2,900 |
| No. 11 | 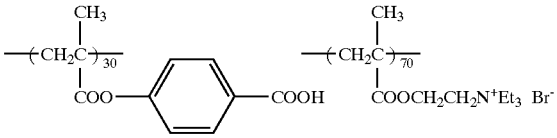 | 800 |
| No. 12 | 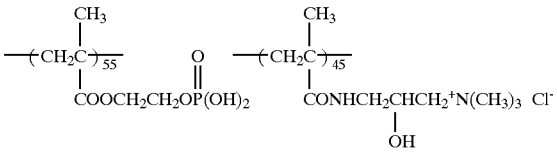 | 300 |
| No. 13 | 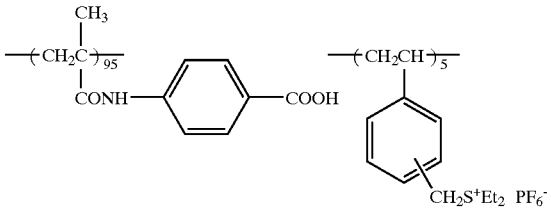 | 1,900 |

-continued
| | | |
|---|---|---|
| No. 14 | 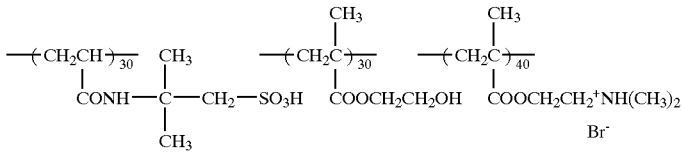 | 4,100 |
| No. 15 | 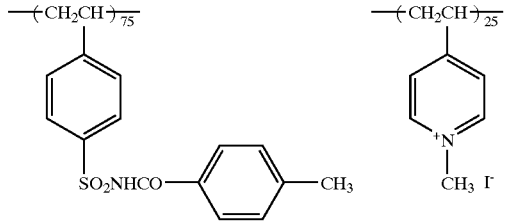 | 3,500 |
| No. 16 | 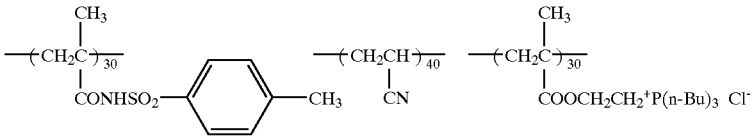 | 3,000 |
| No. 17 | 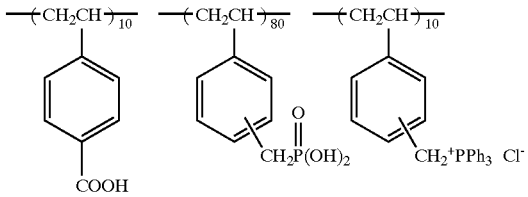 | 3,300 |
| No. 18 | 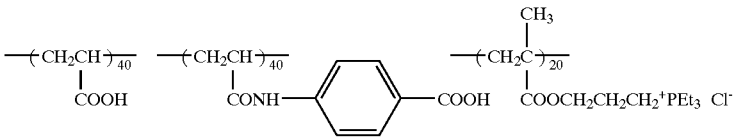 | 600 |
| No. 19 | 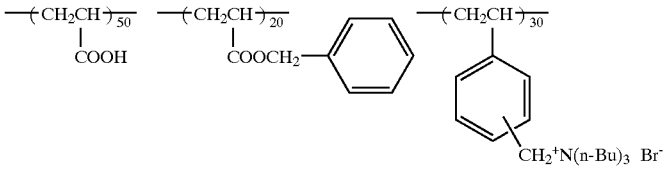 | 5,000 |
| No. 20 | 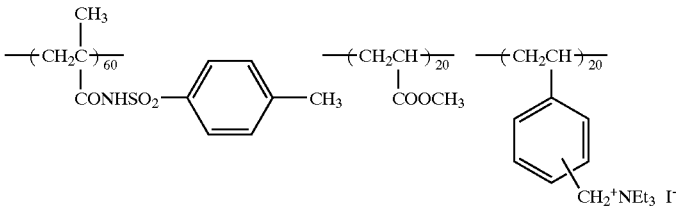 | 2,400 |
| STRUCTURES | WEIGHT-AVERAGE MOLECULAR WEIGHT ($M_w$) |
|---|---|
| No. 21 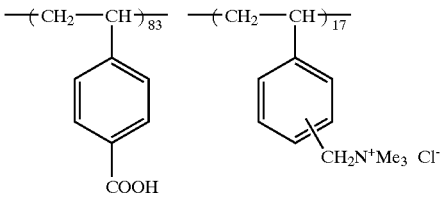 | 32THOUSANDS |

-continued
No. 22
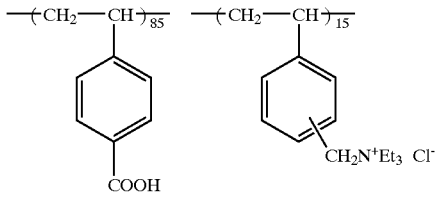
28THOUSANDS
No. 23
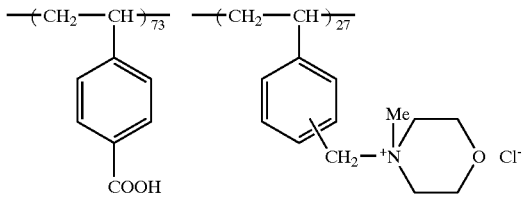
26THOUSANDS
No. 24
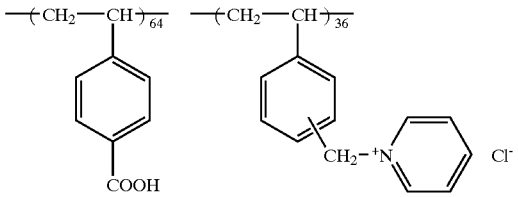
41THOUSANDS
No. 25
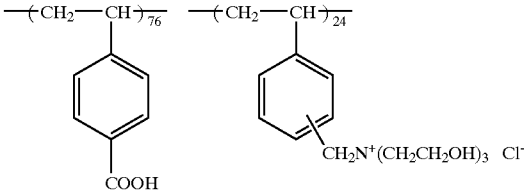
11THOUSANDS
No. 26
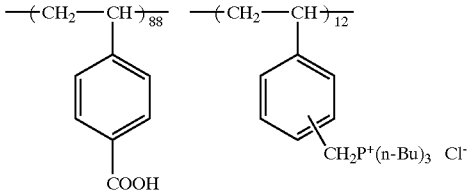
17THOUSANDS
No. 27
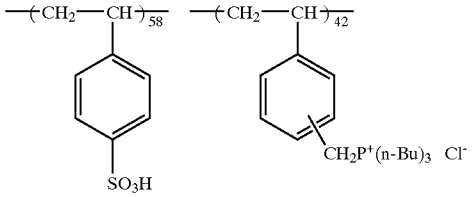
36THOUSANDS
No. 28
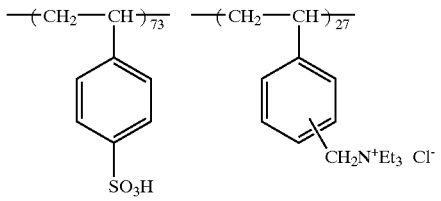
22THOUSANDS -continued
No. 29
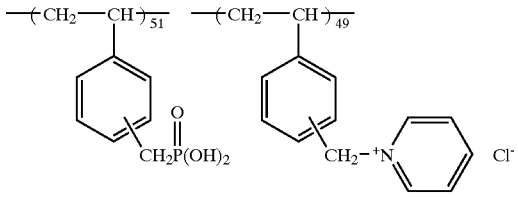
44THOUSANDS
No. 30
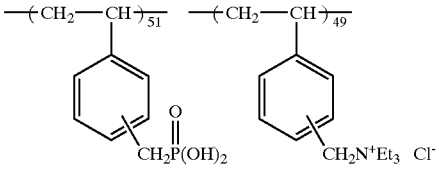
19THOUSANDS
No. 31
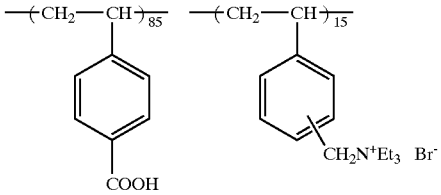
28THOUSANDS
No. 32
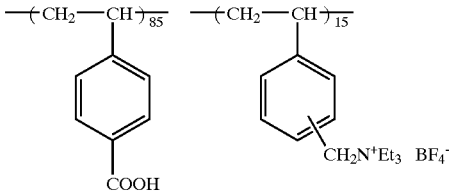
28THOUSANDS
No. 33
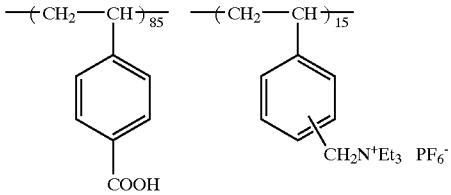
28THOUSANDS
No. 34
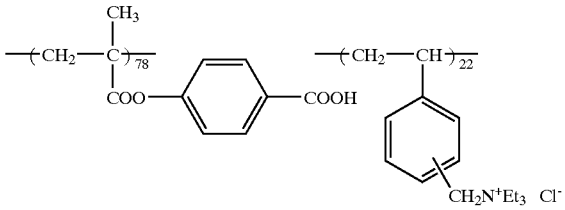
34THOUSANDS
No. 35
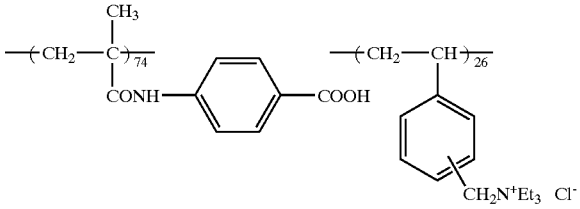
42THOUSANDS
No. 36
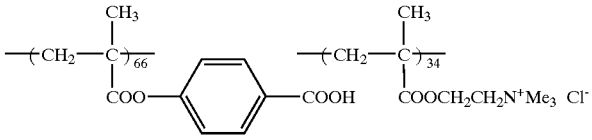
13THOUSANDS -continued
No. 37
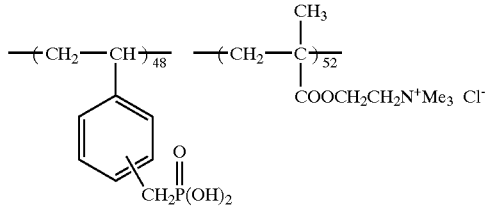
15THOUSANDS
No. 38
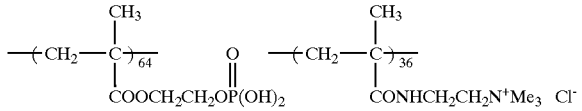
46THOUSANDS
No. 39
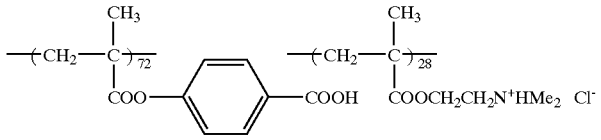
34THOUSANDS
No. 40
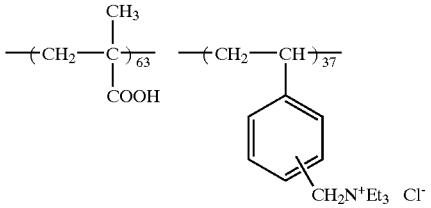
63THOUSANDS
No. 41
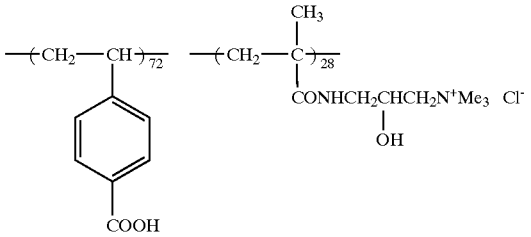
25THOUSANDS
No. 42
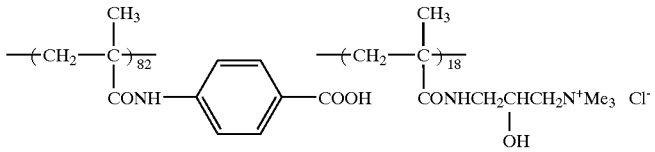
25THOUSANDS
No. 43
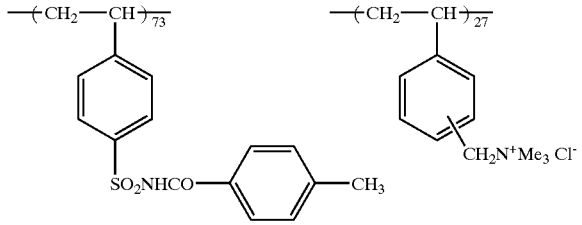
33THOUSANDS -continued No. 44

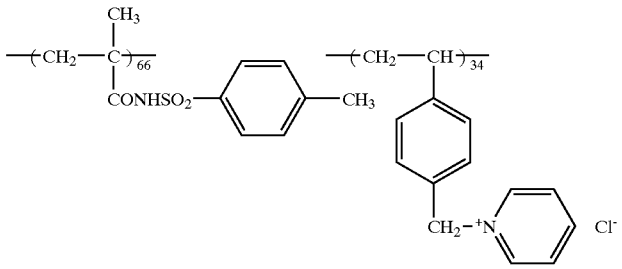

41THOUSANDS

No. 45

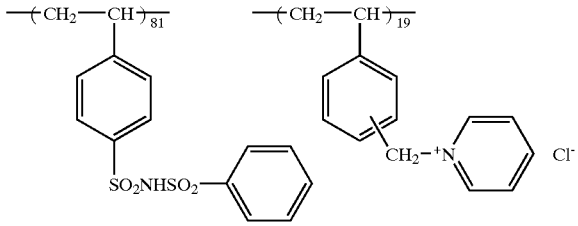

14THOUSANDS

No. 46

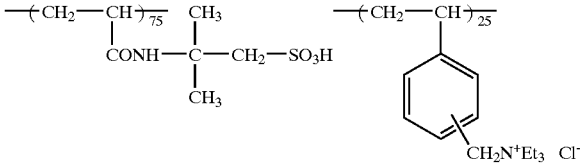

22THOUSANDS

No. 47

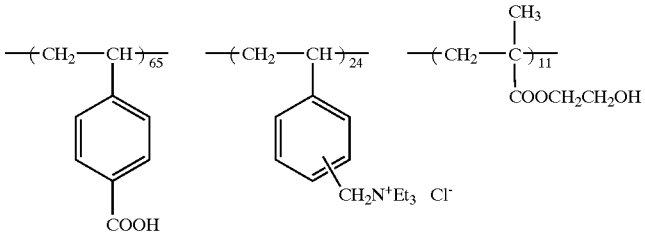

23THOUSANDS

No. 48

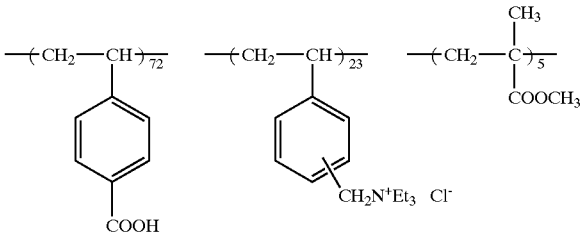

47THOUSANDS

Polymers used in the present invention can be generally produced using radical chain polymerization processes (refer to "Textbook of Polymer Science" 3rd ed. (1984) F. W. Billmeyer, A Wiley-Interscience Publication).

While molecular weights of the polymers used in the present invention can range widely, when measured by using the light scattering method, a weight-average molecular weight ($M_w$) in a range of 500–2,000,000 is preferable, and the range of 1,000–600,000 is more preferable. Also, a number-average molecular weight ($M_w$) calculated with the integrated intensity of end groups and side chain functional groups in the NMR measurement in a range of 300–500,000 is preferable, and the range of 500–100,000 is more preferable. If the molecular weight is smaller than the above range, the adhesion strength to the support becomes weak so that deterioration of the press life may occur. On the other hand, if the molecular weight is larger exceeding the above range, the adhesion strength to the support becomes too strong so that the remains of the photosensitive layer in the non-image areas may result in insufficient removal. Also, while the quantity of the unreacted monomer contained in the polymer can range widely, being 20 wt % or less is preferable, and being 10 wt % or less is more preferable.

The polymer having a molecular weight in the above range can be obtained by using a polymerization initiator and a chain transfer agent together and adjusting addition levels of them at the time when the corresponding monomers are copolymerized. The chain transfer agent refers to a substance that transfers the active site of the reaction by chain transfer reaction in the polymerization reaction, and the susceptibility of the transfer reaction is expressed by a chain transfer constant $C_s$. The chain transfer constant $C_s \times 10^4$ (60° C.) of the chain transfer agent used in the present invention is preferably 0.01 or more, more preferably 0.1 or more, and 1 or more is particularly preferable. As of the polymerization initiator, peroxides, azo compounds and redox initiators that are generally used in radical polymerization can be utilized with no modification. Among them azo compounds. are particularly preferable.

Concrete examples of chain transfer agents include halogen compounds such as carbon tetrachloride and carbon tetrabromide, alcohols such as isopropyl alcohol and isobutyl alcohol, olefins such as 2-methyl-1-butene and 2,4-diphenyl-4-methyl-1-pentene, and sulfur containing compounds such as ethanethiol, butanethiol, dodecanethiol, mercaptoethanol, mercaptopropanol, methyl mercaptopropionate, ethyl mercaptopropionate, mercaptopropionic acid, thioglycolic acid, ethyl disulfide, sec-butyl disulfide, 2-hydroxyethyl disulfide, thiosalicylic acid, thiophenol, thiocresol, benzylmercaptan and phenethylmercaptan, however, the chain transfer agents are not limited to these examples.

More preferred are ethanethiol, butanethiol, dodecanethiol, mercaptoethanol, mercaptopropanol, methyl mercaptopropionate, ethyl mercaptopropionate, mercaptopropionic acid, thioglycolic acid, ethyl disulfide, sec-butyl disulfide, 2-hydroxyethyl disulfide, thiosalicylic acid, thiophenol, thiocresol, benzylmercaptan and phenethylmercaptan, and particularly preferred are ethanethiol, butanethiol, dodecanethiol, mercaptoethanol, mercaptopropanol, methyl mercaptopropionate, ethyl mercaptopropionate, mercaptopropionic acid, thioglycolic acid, ethyl disulfide, sec-butyl disulfide and 2-hydroxyethyl disulfide.

Also, while the quantity of the unreacted monomer contained in the polymer can range widely, being 20 wt % or less is preferable, and being 10 wt % or less is more preferable.

Next, description will be made for synthetic examples of the polymer for use in the present invention.

Synthetic Example 1

For synthesis of the polymer (No. 1), 50.4 g of p-vinylbenzoic acid (made by Hokko Chemical Industry Co., Ltd.), 15.2 g of triethyl(p-vinylbenzyl)ammonium chloride, 1.9 g of mercaptoethanol and 153.1 g of methanol were poured into a three-neck flask having a volume of 2 L, heated while being agitated in a flow of nitrogen, and kept at a 60° C. The solution was added with 2.8 g of 2,2'-azobis (isobutyric acid) dimethyl, and continued to be agitated for 30 minutes as it was. Thereafter, a reaction liquid obtained in the above-described manner was dropwise added with a solution obtained by dissolving 201.5 g of p-vinylbenzoic acid, 60.9 g of triethyl(p-vinylbenzyl)ammonium chloride, 7.5 g of mercaptoethanol and 11.1 g of 2,2' dimetylazobis (isobutyric acid) in 612.3 g of methanol for 2 hours. After the end of dropping, the solution was heated to 65° C., and continued to be agitated for 10 hours in a flow of nitrogen. After the end of reaction, the reaction liquid obtained was cooled to a room temperature. A yield of the reaction liquid was 1,132 g, and a concentration of a solid thereof was 30.5 wt %. Moreover, a number-average molecular weight ($M_n$) of a product obtained was obtained by $^{13}$C-NMR spectrum. A value thereof resulted in 2,100.

Synthetic Example 2

For synthesis of the polymer (No. 2), a similar operation to that for the synthetic example 1 was performed except that a mixture with a field m/p: 2/1 of triethyl(vinylbenzyl) ammonium chloride was used in place of triethyl(p-vinylbenzyl)ammonium chloride, and that ethyl mercaptopropionate was used in place of mercaptoethanol. As a result, a polymer having a number-average molecular weight ($M_n$) of 4,800 was obtained.

Synthetic Example 3

For synthesis of the polymer (No. 25), 146.9 g (0.99 mol) of p-vinylbenzoic acid (made by Hokko Chemical Industry Co., Ltd.), 44.2 g (0.21 mol) of vinylbenzyltrimethylammonium chloride and 446 g of 2-methoxyethanol were poured into a three-neck flask having a volume of 1 L, heated while being agitated in a flow of nitrogen, and kept at a 75° C. Next, the solution was added with 2.76 g (12 mmol) of 2,2'-azobis(isobutyric acid) dimethyl, and continued to be agitated. 2 hours later, 2.76 g (12 mmol) of 2,2'-azobis (isobutyric acid) dimethyl was added thereto. 2 more hours later, 2.76 g (12 mmol) of 2,2'-azobis(isobutyric acid) dimethyl was added thereto. After being agitated for 2 more hours, the solution was cooled to a room temperature. The reaction liquid obtained was poured into 12 L of ethyl acetate under agitation. A solid deposited was filtered and dried. A yield thereof was 189.5 g. A molecular weight of the solid obtained was measured by a light dispersion method, and a weight-average molecular weight ($M_w$) thereof resulted in 32 thousands.

Other polymers for use in the present invention are synthesized in the same manner as described above.

Moreover, into the intermediate layer of the presensitized plate of the present invention, a compound represented by the following general formula (6) can be also added as well as the foregoing polymers.

$$(HO)_m—R_1—(COOH)_n \quad (6)$$

In the formula, a reference code $R_1$ denotes an arylene group having 6 to 14 carbon atoms, and reference codes m and n each independently denotes an integer from 1 to 3.

Description will be made below for the compound represented by the general formula (6) shown above. Preferably, the number of carbon atoms of the arylene group denoted by the code $R_1$ is 6 to 14, more preferably, 6 to 10. Concrete examples of the arylene group represented by the code $R_1$ include a phenylene group, a naphtyl group, an anthryl group and a phenathryl group. The arylene group denoted by the code $R_1$ may be substituted for an alkyl group having 1 to 10 carbon atoms, an alkenyl group having 2 to 10 carbon atoms, an alkynyl group having 2 to 10 carbon atoms, an aryl group having 6 to 10 carbon atoms, a carboxylic ester group, an alkoxy group, a phenoxy group, a surfuric ester group, a phosphonic ester group, a sulfonyl amide group, a nitro group, a nitrile group, an amino group, a hydroxy group a halogen atom, an ethylene oxide group, a propylene oxide group, a triethyl ammonium chloride group or the like.

Concrete examples of the compounds represented by the general formula (6) include 3-hydroxybenzoic acid, 4-hydroxybenzoic acid, salicylic acid, 1-hydroxy-2-naphthoic acid, 2-hydroxy-1-naphthoic acid, 2-hydroxy-3-naphthoic acid, 2, 4-dihydroxybenzoic acid, and 10-hydroxy-9-anthracenecarboxylic acid. However, the compound is not limited to the above-described concrete examples. Moreover, the compound represented by the general formula (6) may be singly used, or two or more of the compounds may be mixed for use.

The intermediate layer including the foregoing polymer for use in the present invention and the compound represented by the foregoing general formula (6), which is added according to needs, is provided by being coated on the above-described aluminum support by various methods.

As methods for providing the intermediate layer, for example, the following two methods can be enumerated. One is a coating method for providing an intermediate layer. In the method, the polymer for use in the present invention and the compound represented by the general formula (6), which is added according to needs, are dissolved in an organic solvent such as methanol, ethanol and methyl ethyl ketone, a mixed solvent of these organic solvents or a mixed solvent of one or more of these organic solvents and water. The solution obtained in the above-described manner is coated on the aluminum support, and dried. In another method, the polymer for use in the present invention and the compound represented by the general formula (6), which is added according to needs, are dissolved in an organic solvent such as methanol, ethanol and methyl ethyl ketone, a mixed solvent of these organic solvents or a mixed solvent of one or more of these organic solvents and water. Then, the aluminum support is immersed in the solution obtained in the above-described manner, cleaned by water or air, and then dried.

In accordance with the former method, the solution of the foregoing compounds with a concentration of 0.005 to 10 wt % in total can be coated by various methods. For example, any method including bar coater coating, spin coating, spray coating, curtain coating and the like may be used. In the latter method, a concentration of the solution is 0.005 to 20 wt %, preferably, 0.01 to 10 wt %, an immersion temperature is 0 to 70° C., preferably, 5 to 60° C., and an immersion time is 0.1 second to 5 minutes, preferably 0.5 to 120 seconds.

pH of the foregoing solution can be adjusted so that the solution can be used in a pH ranging from 0 to 12, preferably from 0 to 6, with a basic substance such as ammonia, triethylamine, potassium hydroxide, inorganic acid such as hydrochloric acid, phosphoric acid, sulfuric acid and nitric acid, various organic acidic substances including organic sulfonic acid such as nitrobenzene sulfonic acid and naphthalene sulfonic acid, organic phosphonic acid such as phenylphosphonic acid, organic carbonic acid such as benzoic acid, coumalic acid and malic acid, and organic chloride such as naphthalenesulfonyl chloride and benzenesulfonyl chloride.

Moreover, for improving the tone reproduction characteristic of the presensitized plate, a substance absorbing ultraviolet rays, visible light, infrared rays and the like can be also added.

A coating amount of the compound after being dried, which constitutes the intermediate layer of the presensitized plate of the present invention, is suitably 1 to 100 mg/m$^2$, preferably, 2 to 70 mg/m$^2$, in total. When the foregoing coating amount is less than 1 mg/M$^2$, a sufficient effect is not obtained sometimes. A similar case occurs also when the coating amount is more than 100 mg/m$^2$.

Photosensitive Layer

The photosensitive layer that can become alkali-soluble by heating in the presensitized plate of the present invention contains a positive working photosensitive composition for infrared laser (hereinafter, simply referred to also as "photosensitive composition").

The positive working photosensitive composition for infrared laser, which is contained in the photosensitive layer, contains: at least (A) an alkali-soluble high-molecular compound (referred to also as "high-molecular compound insoluble in water and soluble in an alkali aqueous solution" in this specification); and (C) a compound absorbing light to generate heat (referred to also as "infrared absorbent" in this specification); and preferably, further contains (B) a compound lowering solubility of the high-molecular compound in an alkali solution by dissolving the same in the alkali-soluble high-molecular compound and reducing the solubility lowering action by heating; and further, according to needs, contains (D) another component.

(A) Alkali-Soluble High-Molecular Compound

The alkali-soluble high-molecular compound for use in the present invention is not particularly limited and conventionally well-known one can be employed. Preferably, it is a compound containing, in the molecule, any functional group of (1) phenolic hydroxy group, (2) sulfonamide group and (3) active imide group.

Examples of the high-molecular compounds containing (1) phenolic hydroxy groups include novolac resin and pyrogallol acetone resin such as phenol-formaldehyde resin, m-cresol-formaldehyde resin, p-cresol-formaldehyde resin, m-/p-mixed cresol-formaldehyde resin and phenol/cresol (any of m-, p- and m-/p-) mixed formaldehyde resin.

Besides the above, as the high-molecular compound containing the phenolic hydroxy group, a high-molecular compound containing the phenolic hydroxy group in a side chain thereof can be preferably used. As the high-molecular compound containing the phenolic hydroxy group in the side chain, exemplified is a high-molecular compound obtained by homopolymerizing polymeric monomers made of low-molecular compounds which contains at least one phernolic hydroxy group and at least one polymerizable unsaturated bond or by copolymerizing another polymeric monomer with the concerned monomers.

Examples of the polymeric monomers containing the phenolic hydroxy groups include acrylamide, methacrylamide, acrylic ester, methacrylic ester, which contain the phenolic hydroxy group, and hydroxystyrene. Specifically, the following is preferably used: N-(2-hydroxyphenyl)acrylamide; N-(3-hydroxyphenyl)acrylamide; N-(4-hydroxyphenyl)acrylamide; N-(2-hydroxyphenyl)methacrylamide; N-(3-hydroxyphenyl)methacrylamide; N-(4-hydroxyphenyl)methacrylamide; o-hydroxyphenyl acrylate; m-hydroxyphenyl acrylate; p-hydroxyphenyl acrylate; o-hydroxyphenyl methacrylate; m-hydroxyphenyl methacrylate; p-hydroxyphenyl methacrylate; o-hydroxystyrene; m-hydroxystyrene; p-hydroxystyrene; 2-(2-hydroxyphenyl)ethylacrylate; 2-(3-hydroxyphenyl)ethylacrylate; 2-(4-hydroxyphenyl)ethylacrylate; 2-(2-hydroxyphenyl)ethylmethacrylate; 2-(3-hydroxyphenyl)ethylmethacrylate; 2-(4-hydroxyphenyl)ethylmethacrylate and the like. Such resin containing the phenolic hydroxy group may be used in combination of two types thereof or more.

Moreover, as described in U.S. Pat. No. 4,123,279, a condensed polymer of phenol and formaldehyde containing alkyl groups having 3 to 8 carbon as substituents atoms such as t-butylphenol-formaldehyde resin and octylphenol-formaldehyde resin may be used together.

Examples of the alkali-soluble high-molecular compound containing (2) sulfonamide group include a high-molecular compound obtained by homopolymerizing polymeric monomers containing sulfonamide groups or by copolymerizing another polymeric monomer with the concerned monomers. Examples of the polymeric monomers containing the sulfonamide groups include polymeric monomers made of low-molecular compounds which contains at least one sulfonamide group-NH—$SO_2$ in which at least one hydrogen atom is bonded onto a nitrogen atom and at least one polymerizable unsaturated bond in one molecule. Among these, a low-molecular compound containing any of an acryloyl group, an allyl group and a vinyloxy group and any of a monosubstituted aminosulfonyl group and a substituted sulfonylimino group is preferable. As the compound as described above, for example, enumerated are compounds represented by the following general formulae (I) to (V).

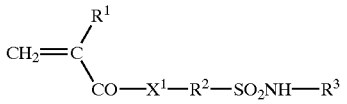

(I)

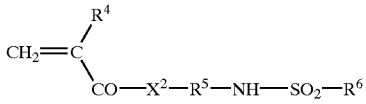

(II)

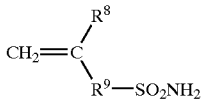

(III)

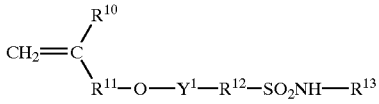

(IV)

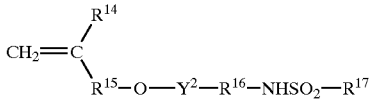

(V)

In the formulae, each of reference codes $X^1$ and $X^2$ independently denotes —O— or —$NR_7$—. Each of reference codes $R^1$ and $R^4$ independently denotes a hydrogen atom or —$CH_3$. Each of reference codes $R^2$, $R^5$, $R^9$, $R^{12}$ and $R^{16}$ independently denotes an alkylene group, a cycloalkylene group, an arylene group or an aralkylene group, each of which may contain a substituent and has 1 to 12 carbon atoms. Each of reference codes $R^3$, $R^7$ and $R^{13}$ independently denotes an alkyl group, a cycloalkyl group, an aryl group or an aralkyl group, each of which may contain a hydrogen atom and a substituent and has 1 to 12 carbon atoms. Moreover, each of reference codes $R^6$ and $R^{17}$ independently denotes an alkyl group, a cycloalkyl group, an aryl group or an aralkyl group, each of which may contain a substituent and has 1 to 12 carbon atoms. Each of reference codes $R^8$, $R^{10}$ and $R^{14}$ independently denotes a hydrogen atom or —$CH_3$. Each of reference codes $R^{11}$ and $R^{15}$ independently denotes a single bond or an alkylene group, a cycloalkylene group, an arylene group or an aralkylene group, each of which may contain a substituent and has 1 to 12 carbon atoms. Each of reference codes $Y^1$ and $Y^2$ independently denotes a single bond or —CO—. Specifically, m-aminosulfonylphenyl methacrylate, N-(p-aminosulfonylphenyl)methacrylamide, N-(p-aminosulfonylphenyl)acrylamide and the like can be preferably used.

The alkali-soluble high-molecular compound containing (3) active imide group preferably contains an active imide group represented by the following formula in the molecule. As the high-molecular compound, exemplified is a high-molecular compound obtained by homopolymerizing polymeric monomers made of low-molecular compounds which contains at least one active imide group represented by the following formula and at least one polymerizable unsaturated bond, or by copolymerizing another polymeric monomer with the concerned monomers.

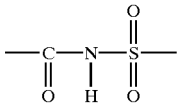

As the compound as described above, specifically, N-(p-toluenesulfonyl)methacrylamide, N-(p-toluenesulfonyl) acrylamide and the like can be preferably used.

Moreover, as preferable alkali-soluble high-molecular compounds for use in the present invention, exemplified are a high-molecular compound obtained by polymerizing two types or more selected from a polymeric monomer containing the above-described phenolic hydroxy groups, a polymeric monomer containing the above-described sulfonamide groups and a polymeric monomer containing the above-described active imide groups, or a high-molecular compound obtained by copolymerizing another polymeric monomer with the concerned two types or more of the polymeric monomers.

In the case where the polymeric monomer containing the phenolic hydroxy group is copolymerized with the polymeric monomer containing the sulfonamide group and/or the polymeric monomer containing the active imide group, a quantity ratio for mixing these components preferably ranges from 50:50 to 5:95, more preferably, ranges from 40:60 to 10:90.

In the case where the alkali-soluble high-molecular compound is a copolymer of a monomer imparting alkali-solubility and another polymeric monomer, the monomer imparting the alkali-solubility including the polymeric monomer containing the above-described phenolic hydroxy group, the polymeric monomer containing the above-described sulfonamide group and the polymeric monomer containing the above-described active imide group, the content of the monomer imparting the alkali solubility is preferably 10 mol % or more, more preferably, 20 mol % or more. When this monomer content is less than 10 mol %, the alkali-solubility tends to be insufficient, and sometimes, an effect of improving a development latitude is not sufficiently achieved.

As the monomer component copolymerized with the polymeric monomer containing the above-described phenolic hydroxy group, the polymeric monomer containing the above-described sulfonamide group and the polymeric monomer containing the above-described active imide group, for example, monomers enumerated in the following (1) to (12) can be used. However, the component is not limited to them.

(1) Acrylic esters and methacrylic esters, each of which contains an aliphatic hydroxy group such as 2-hydroxyethyl acrylate and 2-hydroxyethyl methacrylate.

(2) Alkylacrylates such as methyl acrylate, ethyl acrylate, propyl acrylate, butyl acrylate, amyl acrylate, hexyl acrylate, octyl acrylate, benzyl acrylate, 2-chloroethyl acrylate, glycidyl acrylate and N-dimethylaminoethyl acrylate.

(3) Alkyl methacrylates such as methyl methacrylate, ethyl methacrylate, propyl methacrylate, butyl methacrylate, amyl methacrylate, hexyl metahcrylate, cyclohexyl methacrylate, benzyl methacrylate, 2-chloroethyl methacrylate, glycidyl methacrylate and N-dimethylaminoethyl methacrylate.

(4) Acrylamides and methacrylamides such as acrylamide, methacrylamide, N-methylol acrylamide, N-ethyl acrylamide, N-hexyl methacrylamide, N-cyclohexyl acrylamide, N-hydroxyethyl acrylamide, N-phenyl acrylamide, N-nitrophenyl acrylamide and N-ethyl-N-phenyl acrylamide.

(5) Vinyl ethers such as ethyl vinyl ether, 2-chloroethyl vinyl ether, hydroxyethyl vinyl ether, propyl vinyl ether, butyl vinyl ether, octyl vinyl ether and phenyl vinyl ether.

(6) Vinyl esters such as vinyl acetate, vinyl chloroacetate, vinyl butylate and vinyl benzoate.

(7) Styrenes such as styrene, α-methylstyrene, methylstyrene and chloromethylstyrene.

(8) Vinyl ketones such as methyl vinyl ketone, ethyl vinyl ketone, propyl vinyl ketone and phenyl vinyl ketone.

(9) Olefin grouping such as ethylene, propylene, isobutylene, butadiene and isoprene.

(10) N-vinylpyrrolidone, N-vinylcarbazole, 4-vinylpyridine, acrylonitrile, methacrylonitrile and the like.

(11) Unsaturated imides such as maleimide, N-acryloylacrylamide, N-acetylmethacrylamide, N-propionylmethacrylamide and N-(p-chlorobenzoyl) methacrylamide.

(12) Unsaturated carboxylic acids such as acrylic acid, methacrylic acid, maleic anhydride and itaconic acid.

In the present invention, in the case where the alkali-soluble high-molecular compound is a homopolymer or copolymer of the polymeric monomer containing the above-described phenolic hydroxy group, the polymeric monomer containing the above-described sulfonamide group or the polymeric monomer containing the above-described active imide group, preferably, a weight-average molecular weight thereof is 2,000 or more, and a number-average molecular weight thereof is 500 or more. More preferably, the weight-average molecular weight ranges from 5,000 to 300,000, and the number-average molecular weight ranges from 800 to 250,000, and, a degree of dispersion thereof (weight-average molecular weight/number-average molecular weight) ranges between 1.1 and 10.

Moreover, in the present invention, in the case where the alkali-soluble high-molecular compound is resin such as phenol formaldehyde resin and cresol aldehyde resin, preferably, the weight-average molecular weight thereof ranges from 500 to 20,000, and the number-average molecular weight thereof ranges from 200 to 10,000.

The alkali-soluble high-molecular compound described above may be singly used, or the compounds may be used in a combination of two or more thereof. The weight percentage of the added alkali-soluble high-molecular compound based on the total solids of the photosensitive layer preferably ranges from 30 to 99 wt %, more preferably from 40 to 95 wt %, much more preferably from 50 to 90 wt %. When the weight percentage of the added alkali-soluble high-molecular compound is less than 30 wt %, the durability of the photosensitive layer is deteriorated. And it is not preferable in both of the photosensitivity and the durability that the weight percentage thereof exceeds 99 wt %.

(B) Compound Lowering Solubility of the High-Molecular Compound in an Alkali Solution by Dissolving the Same in the Alkali-Soluble High-Molecular Compound and Reducing the Solubility Lowering Action by Heating (B) component has properties as follows. Specifically, due to the action of the hydrogen-bonding functional group present in the molecule, the solubility of (B) component with (A) alkali-soluble high-molecular compound is good, thus enabling the formation of even coating liquid. Moreover, due to the interaction with (A) component, (B) component can inhibit the alkali-solubility of the concerned high-molecular compound.

Moreover, with regard to (B) compound, the solubility lowering action thereof disappears by heating. However, in the case where (B) component itself is a compound decomposed by heating, when an energy sufficient for the decomposition is not imparted thereto depending on conditions such as a laser output and an irradiation time, there causes a fear of insufficient lowering of the solubility controlling action and lowering of the photosensitivity. Accordingly, the thermal decomposition temperature of (B) component is preferably 150° C. or more.

Examples of preferable (B) compounds for use in the present invention include compounds such as a sulfonic compound, ammonium salt, phosphonium salt and an amide compound, which interact with the above-described (A) component. As described above, (B) component should be appropriately selected in consideration of the interaction with (A) component. Specifically, for example, in the case where the novolak resin is singly used as (A) component, cyanine dye A or the like to be exemplified later is suitably used.

Preferably, the mixing amount ratio of (A) component to (B) component usually ranges from 99/1 to 75/25. In the case where (B) component is contained less than 1%, the interaction with (A) component becomes insufficient, and the alkali solubility cannot be inhibited, thus causing difficulty in forming a good image. Moreover, in the case where (B) component is contained more than 25%, since the interaction is excessive, the photosensitivity is significantly lowered. Both of the above-described cases are not preferable.

(C) Compound Absorbing Light to Generate Heat

The compound absorbing light to generate heat in the present invention is referred to as a compound having a light absorbing band in an infrared ray range of 700 nm or more, preferably 750 to 1200 nm, and having a photothermal conversion function made to emerge in light of a wavelength in the above-described band. Specifically, various pigments and dyes absorbing the light of the above-described wavelengths to generate heat can be used. As the above-described pigments, commercially available pigments or pigments described in "Color Index (C. I.) Handbook", "Latest Pigment Handbook (Saishin Ganryo Binran)" (edited by Japan Association of Pigment Technology, 1977), "Latest Pigment Application Technology (Saishin Ganryo Oyo Gijyutsu)" (CMC, 1986) and "Printing Ink Technology (Insatsu Inki Gijyutsu)" (CMC, 1984) can be used.

Examples of the above-described pigments include a black pigment, an yellow pigment, an orange pigment, a brown pigment, a red pigment, a purple pigment, a blue pigment, a green pigment, a fluorescent pigment, a metal powder pigment and a polymer-bonded dyestuff. Specific examples of the pigments include an insoluble azo pigment, an azo lake pigment, a condensed azo pigment, a chelate azo pigment, a phthalocyanine-based pigment, an anthraquinone-based pigment, a perylene and perinone-based pigment, a thioindigo-based pigment, a quinacridone-based pigment, a dioxazine-based pigment, an isoindolinone-based pigment, a quinophthalone-based pigment, a dyeing lake pigment, an azine pigment, a nitroso pigment, a nitro pigment, a natural pigment, an inorganic pigment and a carbon black.

These pigments may be used without surface treatment or may be used after the surface treatment. Surface treatment methods include a surface coating method with resin and wax, a method of adhering surfactant, a method of bonding a reactive substance (for example, a silane coupling agent, an epoxy compound and polyisocyanate) to a pigment surface. The above-described surface treatment methods are described in "Properties and Applications of Metal Soaps" (Saiwai Shobo Co., Ltd.), "Printing Ink Technology (Insatsu Inki Gijyutsu)" (CMC, 1984) and "Latest Pigment Application Technology (Saishin Ganryo Oyo Gijyutsu)" (CMC, 1986).

A particle diameter of the above-described pigments preferably ranges from 0.01 to 10 μm, more preferably from 0.05 to 1 μm, much more preferably from 0.1 to 1 μm. It is not preferable that the particle diameter of the pigments be less than 0.01 μm in terms of stability of the dispersant in the photosensitive layer coating liquid. And, it is not preferable that the particle diameter exceeds 10 μm in terms of evenness of the photosensitive layer.

As a method of dispersing the above-described pigments, a well-known dispersing technology for use in preparing ink, toner and the like can be used. Examples of the dispersing machine include an ultrasonic dispersing machine, a sandmill, an atritor, a pearl mill, a super mill, a ball mill, an impeller, a disperser, a KD mill, a colloid mill, a dynatron, a three-roll mill and a pressurizing kneader. Details thereof are described in "Latest Pigment Application Technology (Saishin Ganryo Oyo Gijyutsu)" (CMC, 1986).

As the above-described dyes, commercially available dyes and well-known dyes described in documents (for example, "Dye Handbook" edited by The Society of Synthetic Organic Chemistry, Japan, 1970) can be used. Specific examples of the dyes include an azo dye, an azo dye in the form of a metallic complex salt, a pyrazolone azo dye, a naphthoquinone dye, an anthraquinone dye, a phthalocyanine dye, a carbonium dye, a quinoneimine dye, a methyne dye, a cyanine dye.

In the present invention, among the above-described pigments and dyes, the ones absorbing infrared rays or near-infrared rays are particularly preferable in that they are suitable for use in a laser emitting the infrared rays or near-infrared rays.

As such pigments absorbing the infrared rays or near-infrared rays, carbon black is preferably used. Moreover, examples of the dyes absorbing the infrared rays or near-infrared rays include the cyanine dye described in JP 58-125246 A, JP 59-84356 A, JP 59-202829 A, JP 60-78787 A and the like, the methyne dye described in JP 58-173696 A, JP 58-181690 A, JP 58-194595 A and the like, the naphthoquinone dye described in JP 58-112793 A, JP 58-224793 A, JP 59-48187 A, JP 59-73996 A, JP 60-52940 A, JP 60-63744 A and the like, the squarylium dyestuff described in JP 58-112792 A and the like, the cyanine dye described in GB 434,875 B and the dihydroperimidine squarylium described in U.S. Pat. No. 5,380,635.

Moreover, as the above-described dye, the near-infrared ray absorbing sensitizer described in U.S. Pat. No. 5,156,938 is also preferably used. Furthermore, more preferably used are the substituted aryl benzo(thio)pyrylium salt described in U.S. Pat. No. 3,881,924, the trimethyne thiopyrylium salt described in JP 57-142645 A (U.S. Pat. No. 4,327,169), the pyrylium series compound described in JP 58-181051 A, JP 58-220143 A, JP 59-41363 A, JP 59-84248 A, JP 59-84249 A, JP 59-146063 A and JP 59-146061 A, the cyanine dyestuff described in JP 59-216146 A, the pentamethyne thiopyrylium salt and the like described in U.S. Pat. No. 4,283,475, the pyrylium compound described in JP 5-13514 B and JP 5-19702 B; Epolight III-178, Epolight III-130, Epolight III-125, Epolight IV-62A and the like.

Moreover, as another example of the above-described more preferable dyes, the near-infrared ray absorbing dye represented in the formula (I) or (II) in U.S. Pat. No. 4,756,993 is enumerated.

These pigments or dyes can be added into the above-described photosensitive composition in the following amounts to the total solids of the photosensitive layer. Specifically, the amount added ranges preferably from 0.01 to 50 wt %, more preferably from 0.01 to 10 wt %. In the case of dye, the amount ranges particularly preferably from 0.5 to 10 wt %. In the case of pigments, the amount ranges particularly preferably from 3.1 to 10 wt %. When an additional amount of the pigment or dye is less than 0.01 wt %, the photosensitivity is lowered. When the additional amount exceeds 50 wt %, the evenness of the photosensitive layer is lost, and the durability of the photosensitive layer is deteriorated.

Each of these pigments or dyes may be added into the same layer as that having other components. Alternatively, another layer may be provided, and each of these pigments or dyes may be added thereinto. In the case where another layer is provided, preferably, another layer is provided to be adjacent to the layer containing the substance of the present invention, which has thermal decomposability and substantially lowers the solubility of the alkali-soluble high-molecular compound in an undecomposed state, and the pigment or dye is added thereinto.

Moreover, though the dye or pigment and the alkali-soluble high-molecular compound are preferably included in the same layer, it does not matter if the dye or pigment and the alkali-soluble high-molecular compound are included in layers different from each other.

(B+C) Component

In the present invention, in place of (B) compound lowering solubility of the high-molecular compound in the alkali solution by dissolving the same in the alkali-soluble high-molecular compound and reducing the solubility lowering action by heating and (C) compound absorbing light to generate heat, one compound having properties of the both compounds described above (hereinafter, also referred to as "(B+C) component") can be also made to contain. As such a compound, for example, ones represented by the following general formula (Z) are enumerated.

(Z)

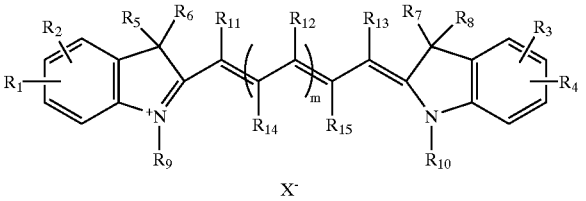

In the above-described general formula (Z), each of reference codes $R_1$ to $R_4$ independently denotes a hydrogen atom or an alkyl group, an alkenyl group, an alkoxy group, a cycloalkyl group or an aryl group, each of which has 1 to 12 carbon atoms and may contain a substituent. $R_1$ and $R_2$, as well as $R_3$ and $R_4$, may be respectively bonded to form a ring structure. Here, specific examples of $R_1$ to $R_4$ include a hydrogen atom, a methyl group, an ethyl group, a phenyl group, a dodecyl group, a naphthyl group, a vinyl group, an aryl group, and a cyclohexyl group. In the case where these groups contain substituents, examples of the substituents include a halogen atom, a carbonyl group, a nitro group, a nitrile group, a sulfonyl group, a carboxy group, carboxylic ester and sulfonic ester.

Each of reference codes $R_5$ to $R_{10}$ independently denotes an alkyl group which has 1 to 12 carbon atoms and may contain a substituent. Here, specific examples of $R_5$ to $R_{10}$ include a methyl group, an ethyl group, a phenyl group, a dodecyl group, a naphtyl group, a vinyl group, an allyl group, and a cyclohexyl group. In the case where these groups contain substituents, examples of the substituents include a halogen atom, a carbonyl group, a nitro group, a nitrile group, a sulfonyl group, a carboxy group, carboxylic ester, and sulfonic ester.

Each of reference codes $R_{11}$ to $R_{13}$ independently denotes an alkyl group which has 1 to 8 carbon atoms and may contain a hydrogen atom, a halogen atom or a substituent. Here, $R_{12}$ may be bonded to $R_{11}$ or $R_{13}$ to form a ring structure. In the case of m>2, a plurality of $R_{12}$ may be bonded to each other to form a ring structure. Specific examples of $R_{11}$ to $R_{13}$ include a chlorine atom, a cyclohexyl group, and cyclopentyl and cyclohexyl rings composed by bonding $R_{12}$ to each other. In the case where these groups contain substituents, examples of the substituents include a halogen atom, a carbonyl group, a nitro group, a nitrile group, a sulfonyl group, a carboxy group, carboxylic ester, and sulfonic ester. Moreover, a reference code m denotes an integer of 1 to 8, preferably 1 to 3.

Each of reference codes $R_{14}$ and $R_{15}$ independently denotes a hydrogen atom, a halogen atom or an alkyl group which has 1 to 8 carbon atoms and may contain a substituent. $R_{14}$ may be bonded to $R_{15}$ to form a ring structure. In the case of m>2, a plurality of $R_{14}$ may be bonded to each other to form a ring structure. Specific examples of $R_{14}$ and $R_{15}$ include a chlorine atom, a cyclohexyl group and cyclopentyl and cyclohexyl rings composed by bonding $R_{14}$ to each other. In the case where these groups contain substituents, examples of the substituents include a halogen atom, a carbonyl group, a nitro group, a nitrile group, a sulfonyl group, a carboxy group, carboxylic acid ester and sulfonic acid ester. Moreover, a reference code m denotes an integer of 1 to 8, preferably 1 to 3.

In the above-described general formula (Z), a reference code $X^-$ denotes anion. Concrete examples of compounds that become anion include perchloric acid, tetrafluoroboric acid, hexafluorophosphoric acid, triisopropyl naphthalene sulfonic acid, 5-nitro-o-toluenesulfonic acid, 5-sulfosalicylic acid, 2,5-dimethylbenzenesulfonic acid, 2,4,6-trimethylbenzenesulfonic acid, 2-nitrobenzenesulfonic acid, 3-chlorobenzenesulfonic acid, 3-bromobenzenesulfonic acid, 2-fluorocaprylnaphthalenesulfonic acid, dodecylbenzenesulfonic acid, 1-naphthol-5-sulfonic acid, 2-methoxy-4-hydroxy-5-benzoyl-benzenesulfonic acid and paratoluenesulfonic acid. Among them, particularly, hexafluorophosphoric acid, triisopropylnaphthalenesulfonic acid and alkylaromatic sulfonic acid such as 2,5-dimethylbenzenesulfonic acid are preferably used.

The compound represented by the above-described general formula (Z) is a compound generally called cyanine dye. Specifically, compounds to be described below are preferably used. However, the present invention is not limited to these concrete examples.

CYANINE DYE A

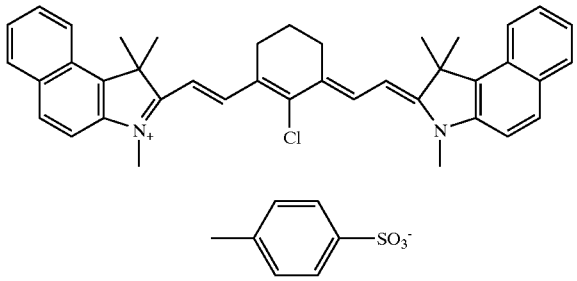

-continued

CYANINE DYE B

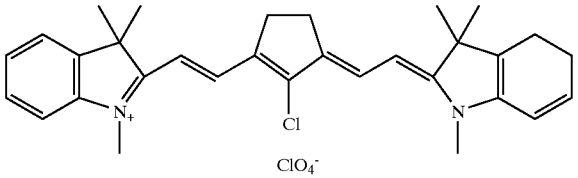

CYANINE DYE C

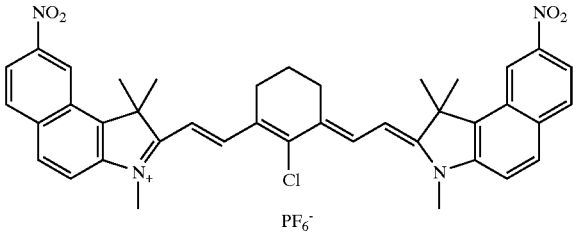

CYANINE DYE D

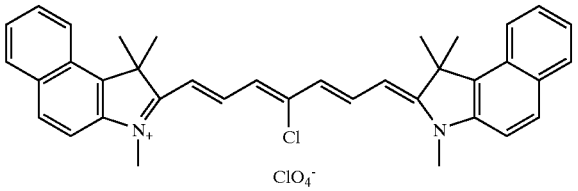

CYANINE DYE E

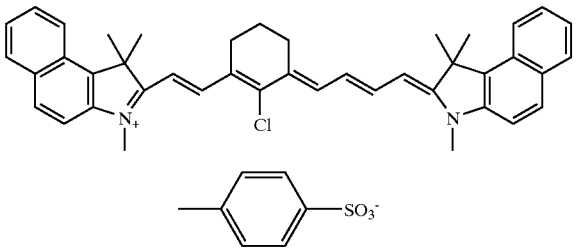

The above-described (B+C) component has a property to absorb light to generate heat (that is, property of (c) component). Moreover, the (B+C) component has a light absorbing band in the infrared region from 700 to 1,200 nm. Furthermore, the (B+C) component is good in compatibility with the alkali-soluble high-molecular compound, is basic dye, and contains, in a molecule, a group interacting on the alkali-soluble high-molecular compound containing an ammonium group and an iminium group (that is, has a property of (B) component). Accordingly, the (B+C) component can interact with the concerned high-molecular compound to control the alkali-solubility thereof, thus being preferably usable for the present invention.

In the present invention, in the case where the (B+C) component such as the above-described cyanine dye having the both properties of (B) component and (C) component is used in place of the same, the amount ratio of this compound to (A) component preferably ranges from 99/1 to 70/30 in terms of the photosensitivity, more preferably ranges from 99/1 to 75/25.

(D) Other Components

Various additives can be further added to the above-described photosensitive composition for use in the present invention according to needs. For example, for the purpose of increasing the photosensitivity, cyclic acid anhydrides, phenols, organic acids or sulfonyl compounds can be used together therewith.

Examples of the cyclic acid anhydrides include phthalic anhydride, tetrahydrophthalic anhydride, hexahydrophthalic anhydride, 3,6-endoxy-Δ4-tetrahydrophthalic anhydride, tetrachlorophthalic anhydride, maleic anhydride, chloromaleic anhydride, α-phenylmaleic anhydride, succinic anhydride and pyromellitic anhydride, which are described in U.S. Pat. No. 4,115,128.

Examples of the phenols include bisphenol A, p-nitrophenol, p-ethoxyphenol, 2,4,4'-trihydroxy benzophenone, 2,3,4-trihydroxy benzophenone, 4-hydroxy benzopenone, 4,4',4"-trihydroxy triphenylmethane, 4,4',3", 4"-tetrahydroxy-3,5,3',5'-tetramethyl triphenylmethane.

Examples of the organic acids include sulfonic acids, sulfinic acids, alkyl sulfuric acids, phosphonic acids, phosphoric esters and carboxylic acids, which are describe in JP 60-88942 A and JP 2-96755 A. Specific examples include p-toluenesulfonic acid, dodecylbenzenesulfonic acid, p-toluenesulfinic acid, ethylsulfuric acid, phenylphosphonic acid, phenylphosphinic acid, phenyl phosphate, diphenyl phosphate, benzoic acid, isophthalic acid, adipic acid, p-toluic acid, 3,4-dimethoxy benzoic acid, phthalic acid, terephtalic acid, 4-cyclohexene-1,2-dicarboxylic acid, erucic acid, lauric acid, n-undecanoic acid, ascorbic acid, bis(hidroxyphenyl)sulfone, methyl phenyl sulfone and diphenyl disulfone.

Amounts of the foregoing cyclic acid anhydride, phenols, organic acid groups and sulfonyl compounds in the total solids of the above-described photosensitive composition preferably ranges from 0.05 to 20 wt %, more preferably from 0.1 to 15 wt %, particularly preferably from 0.1 to 10 wt %.

Moreover, into the above-described photosensitive composition in the present invention, surfactant to be described below can be added for the purpose of increasing treatment stability to the developing conditions. Specifically, the surfactant includes nonionic surfactant as described in JP 62-251740 A and JP 3-208514 A and amphoteric surfactant as described in JP 59-121044 A and JP 4-13149 A.

Concrete examples of the above-described nonionic surfactant include sorbitan tristearate, sorbitan monopalmitate, sorbitan triolate, stearic acid monoglyceride and polyoxyethylene nonylphenyl ether.

Concrete examples of the above-described amphoteric surfactant include alkyldi(aminoethyl)glycin, alkyl polyaminoethyl glycin hydrochloride, 2-alkyl-N-carboxyethyl-N-hydroxyethyl imidazolinium betaine and N-tetradecyl-N,N-betaine type (for example, article name "Amogen K", made by Dai-ichi Kogyo Co., Ltd.).

The content of each of the foregoing nonionic surfactant and the amphoteric surfactant in the total solids of the above-described photosensitive composition preferably ranges from 0.05 to 15 wt %, more preferably 0.1 to 5 wt %.

Into the above-described photosensitive composition for use in the present invention, a printing out agent for obtaining a visible image immediately after heating by exposure, as well as the dye or the pigment as an image coloring agent, can be added.

As printing out agent, combination of a compound releasing acid by heating by exposure (photo-acid releasing agent) and an organic dye capable of forming salt is exemplified. Specifically, enumerated are combination of o-naphthoquinone diazide-4-sulfonic acid halogenide and salt-forming organic dye, which are described in JP 50-36209 A and JP 53-8128 A and combination of a trihalomethyl compound and a salt-forming organic dye, which are described in JP 53-36223 A, JP 54-74728 A, JP 60-3626 A, JP 61-143748 A, JP 61-151644 A and JP 63-58440 A. As such trihalomethyl compound, there are a oxazole series compound and a triazine series compound, both of which exhibit storability, and produce a clear printed out image.

As image coloring agent, dyes other than the above-described salt-forming organic dye can be used. As preferable dyes, an oil soluble dye and a basic dye including the salt-forming organic dye can be cited. Specific examples include oil yellow #101, oil yellow #103, oil pink #312, oil green BG, oil blue BOS, oil blue #603, oil black BY, oil black BS, and oil black T-505 (these are all made by Orient Chemical Industries Ltd.), Victorian pure blue, crystal violet (C. I. 42555), methyl violet (C. I. 42535), ethyl violet, Rhodamine B (C. I. 145170B), malachite green (C. I. 42000) and methylene blue (C. I. 52015). Particularly preferable dyes are those described in JP 62-293247 A and JP 5-313359 A.

The above dyes can be added into the photosensitive composition preferably at the rate of 0.01 to 10 wt %, more preferably at the rate of 0.1 to 3 wt %, with respect to the solid content thereof.

As occasion demands, plasticizer is added into the photosensitive composition used for the present invention for the purpose of providing a coating layer with flexibility. Examples include butyl phthalyl, polyethylene glycol, tributyl citrate, diethyl phthalate, dibutyl phthalate, dihexyl phthalate, dioctyl phthalate, tricresyl phosphate, tributyl phosphate, trioctyl phosphate, tetrahydrofurfuryl oleate, and acrylic or methacrylic acid oligomer or polymer.

Further, as occasion demands, photodegradable compounds such as quinone diazides, diazo compounds or the like may be added into the photosensitive composition. The amount of adding such compounds should preferably be set in the range of 1 to 5 wt % with respect to the solid content of the photosensitive composition.

The photosensitive layer in the present invention can be prepared typically by dissolving each of the above components in a solvent, and coating it over the support for the lithographic printing plate of the present invention. For the solvent to be used in this case, for example, one can be selected from ethylene dichloride, cyclohexanone, methyl ethyl ketone, methanol, ethanol, propanol, ethylene glycol monomethyl ether, 1-methoxy-2-propanol, 2-methoxyethyl acetate, 1-methoxy-2-propyl acetate, dimethoxy ethane, methyl lactate, ethyl lactate, N, N-dimethyl acetamide, N,N-dimethyl formamide, tetramethyl urea, N-methylpyrrolidone, dimethyl sulfoxide, sulfolane, γ-butyrolactone and toluene. However, the solvent is not limited to these examples, and these solvents can be used either alone or in mixture.

The concentration of the above components in the solvent (all solid contents including additives) should preferably be set in the range of 1 to 50 wt %.

Also, the amount of the photosensitive layer coating (solid content) on the support obtained after coating and drying should preferably be set in the range of generally 0.5 to 5.0 $g/m^2$.

Various methods are available for coating. For example, one may be selected from bar coater coating, rotational coating, spray coating, curtain coating, dip coating, air knife coating, blade coating, and roll coating. As the coating amount is reduced, apparent sensitivity becomes higher, meanwhile, a layer characteristic of the photosensitive layer deteriorates.

Surfactant can be added into the photosensitive layer for the purpose of improving coating performance. For example, fluorine-containing surfactant described in JP 62-170950 A can be used. The preferable amount of addition is in the range of 0.01 to 1 wt % with respect to the entire solid content of the photosensitive layer, and more preferably in the range of 0.05 to 0.5 wt %.

In the present invention, preferably, the surface of the photosensitive layer thus obtained has an average gradient of 0° or more and 5° or less. In other words, the present invention provides the presensitized plate, where the photosensitive layer has the surface of an average gradient of 0° or more and 5° or less.

In the present invention, "average gradient" means an average value of an angle made between an average line and a sectional curve at a portion taken out by a length to be measured from the sectional curve extracted by a surface roughness gauge of a stylus type, and it is represented by the following equation (1).

$$\theta_a = \tan^{-1}\left(\frac{1}{L}\int_0^L \left|\frac{d}{dx}f(x)\right| dx\right) \quad (1)$$

Herein, θa is an average gradient, L is a length to be measured, and f(x) is a sectional curve.

The inventors discovered that for a level of fine asperities of the photosensitive layer surface, the above-described average gradient θa was a physical property value most accurately indicating the tendency for the photosensitive layer surface to be damaged, and realized the surface of the photosensitive layer which has damage resistance by setting the value in the above-described range.

Further, the inventors discovered that the surface shape of the support for the lithographic printing plate was a factor for deciding a level of the fine asperities of the photosensitive layer surface, and that it was possible to set the value of the average gradient of the photosensitive layer surface in the above-described range by specifying a shape of the surface of the support for the lithographic printing plate.

That is, preferably, the presensitized plate of the present invention is made in accordance with either one of the following two aspects.

(1) The graining treatment is electrolytic graining treatment, and an average depth of a concave portion on the surface of the support for the lithographic printing plate is less than 0.3 μm; and (2) The surface of the support for the lithographic printing plate has a large-medium complex grained structure comprising 2 different frequency undulations consisting of large undulation having a wavelength of 3 to 10 μm and medium undulation having a wavelength of 0.05 to 2.0 μm, wherein an average depth of a concave portion of the large undulation is 0.3 to 1.0 μm, and an average depth of a concave portion of the medium undulation is 0.05 to 0.4 μm.

By forming the above-described photosensitive layer, it is possible to greatly improve the tendency to be damaged easily, which has been a problem inherent in the presensitized plate of the thermal positive working type.

EXAMPLES

The following examples are provided for the purpose of further illustrating the present invention but are in no way to be taken as limiting.

Examples About the First Aspect of the Present Invention

1. Preparation of Presensitized Plates

Example 1

Molten metal was prepared by using an aluminum alloy containing Si: 0.06 wt %, Fe: 0.30 wt %, Cu: 0.014 wt %, Mn: 0.001 wt %, Mg: 0.001 wt %, Zn: 0.001 wt % and Ti: 0.03 wt %, and containing Al and inevitable impurities for the remaining portion. After molten metal processing and filtering, an ingot having a thickness of 500 mm and a width of 1200 mm was made by a DC casting method. After the surface was chipped to have an average thickness of 10 mm by a surface chipper, the ingot was held at 550° C. for about 5 hours for soaking. When the temperature dropped to 400° C., the ingot was formed into a rolled plate having a thickness of 2.7 mm by using a hot rolling mill. Further, after the heat treatment carried out at 500° C. by using a continuous annealing machine, the rolled plate was finished into an aluminum plate having a thickness of 0.24 mm by cold rolling. This aluminum plate was processed to have a width of 1030 mm, and surface treatment described below was continuously carried out.

(a) Mechanical Graining

Mechanical graining was carried out by rotating roller-like nylon brushes while supplying suspension containing abrasive (silica sand) having specific gravity of 1.12 and water as graining slurry liquid to the surface of the aluminum plate, using a device shown in FIG. 1. In FIG. 1, 1 represents an aluminum plate, 2 and 4 represent roll brushes, 3 represents abrasive slurry liquid and 5, 6, 7 and 8 represent supporting rollers. The abrasive had average particle size of 8 μm and maximum particle size of 50 μm. A material for the nylon brush was 6-10 nylon, having a bristle length of 50 mm, and a bristle diameter of 0.3 mm. The nylon brush was made by boring holes in a ϕ 300 mm stainless cylinder and densely implanting bristles therein. Three of such rotary brushes were prepared. Each distance between two supporting rollers (ϕ 200 mm) in the lower part of the brush was 300 mm. Each brush roller was pressed until a load of a driving motor for rotating the brush reached plus 7 kW with respect to the load before the brush roller was pressed to the aluminum plate. The rotating direction of each brush was the same as the moving direction of the aluminum plate. Rotating speed of brushes was 200 rpm.

(b) Alkali Etching

The aluminum plate obtained in the foregoing manner was subjected to spray etching by using aqueous solution containing 2.6 wt % of sodium hydroxide and 6.5 wt % of aluminum ions at a temperature of 70° C., and the aluminum plate was dissolved by 6 g/m$^2$. Then, the aluminum plate was washed by water spraying.

(c) Desmutting

The aluminum plate was subjected to spray desmutting treatment in aqueous solution of nitric acid 1 wt % (containing 0.5 wt % of aluminum ions), and then washed by water spraying. For the aqueous solution of nitric acid used in the desmutting treatment, waste solution generated in the process of electrochemical graining carried out by using an alternating current in the aqueous solution of nitric acid was utilized.

(d) Electrochemical Graining

Figure 2:
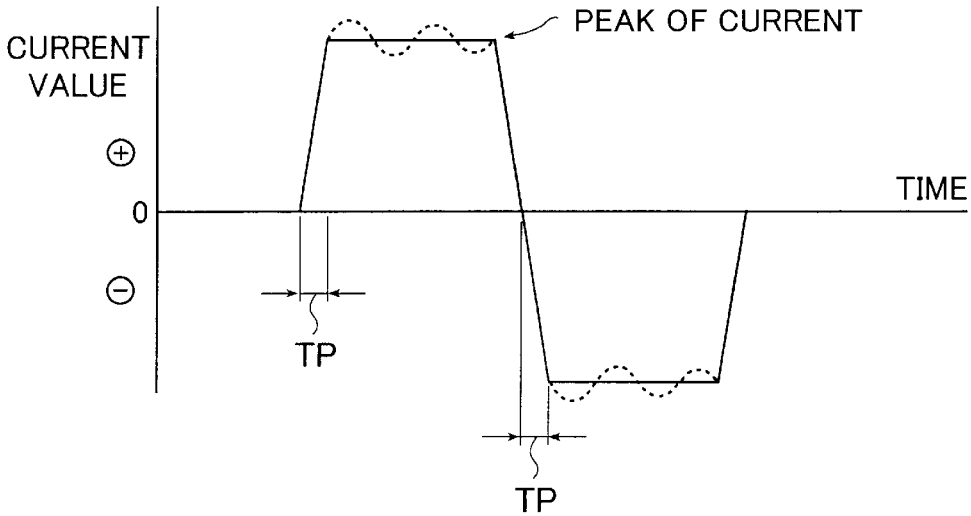
FIG. 2 is a graph showing an example of an alternating current waveform view used for electrochemical graining in preparation of a support for a lithographic printing plate of the present invention.
Figure 3:
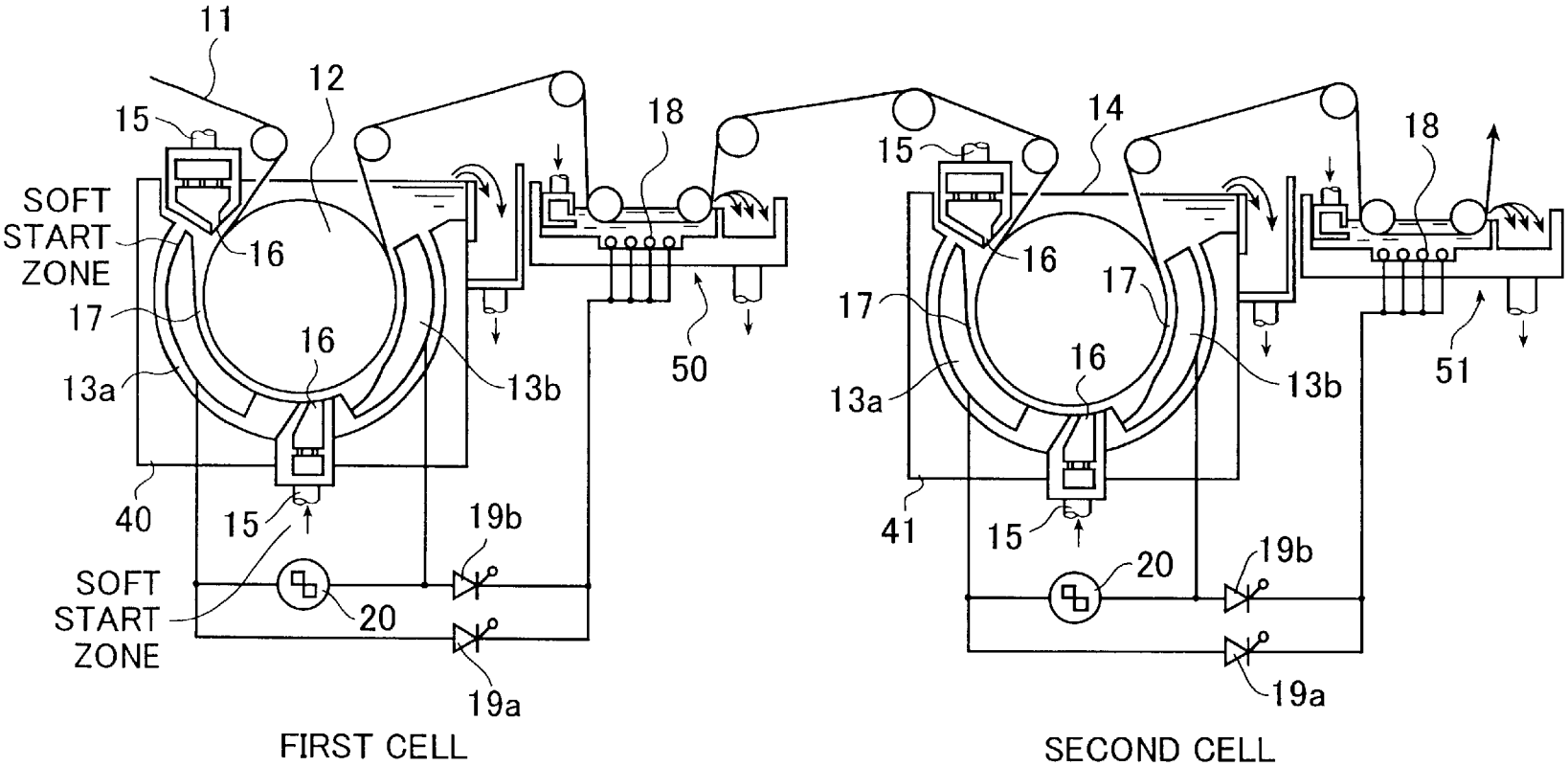
FIG. 3 is a schematic structural view of a device having at least two radial drum rollers connected used for electrochemical graining in preparation of a support for a lithographic printing plate of the present invention.

Electrochemical graining treatment was continuously carried out by using an AC voltage of 60 Hz. Electrolytic solution in this case was the aqueous solution of nitric acid 10 g/L (containing aluminum ions 5 g/L and ammonium ions 0.007 wt %), and the temperature was 80° C. An AC power supply waveform was like that shown in FIG. 2. With the time TP necessary for a current value to reach its peak from zero set at 0 msec, and duty ratio set at 1:1, and by using a trapezoidal wave alternating current, the electrochemical graining treatment was carried out while carbon electrodes were set as counter electrodes. Ferrite was used for an auxiliary anode. An electrolytic cell used is shown in FIG. 3. In FIG. 3, 11 represents an aluminum plate, 12 represents a radial drum roller, 13*a* and 13*b* are main electrodes, 14 represents an electrolytic treatment liquid, 15 represents a supplying opening of the electrolytic solution, 16 represents a slit, 17 represents an electrolytic bath passage, 19*a* and 19*b* represent thyristors, 20 represents an alternating current power source, 40 represents a main electrolytic cell and 50 represents a supplementary anode cell.

A current density was 30 A/dm$^2$ at a current peak value. Regarding the quantity of electricity, the total of the quantity of electricity was 130 C/dm$^2$ when the aluminum plate was at the anode side. An amount equivalent to 5% of a current flowing from a power source was diverted to the auxiliary anode.

Then, the aluminum plate was washed by water spraying.

(e) Alkali Etching

The aluminum plate was subjected to spray etching by using aqueous solution containing 26 wt % of sodium hydroxide and 6.5 wt % of aluminum ions at a temperature of 32° C. The aluminum plate was dissolved by 0.2 g/m$^2$, a smut component mainly containing aluminum hydroxide generated in the previous stage of the electrochemical graining carried out by using the alternating current was removed, and the edge portion of a formed pit was dissolved to be made smooth. Then, the aluminum plate was washed by water spraying.

(f) Desmutting

The aluminum plate was subjected to spray desmutting in aqueous solution of sulfuric acid 25 wt % (containing 0.5 wt % of aluminum ions) at a temperature of 60° C. Then, the aluminum plate was washed by water spraying.

(g) Anodizing

Figure 4:
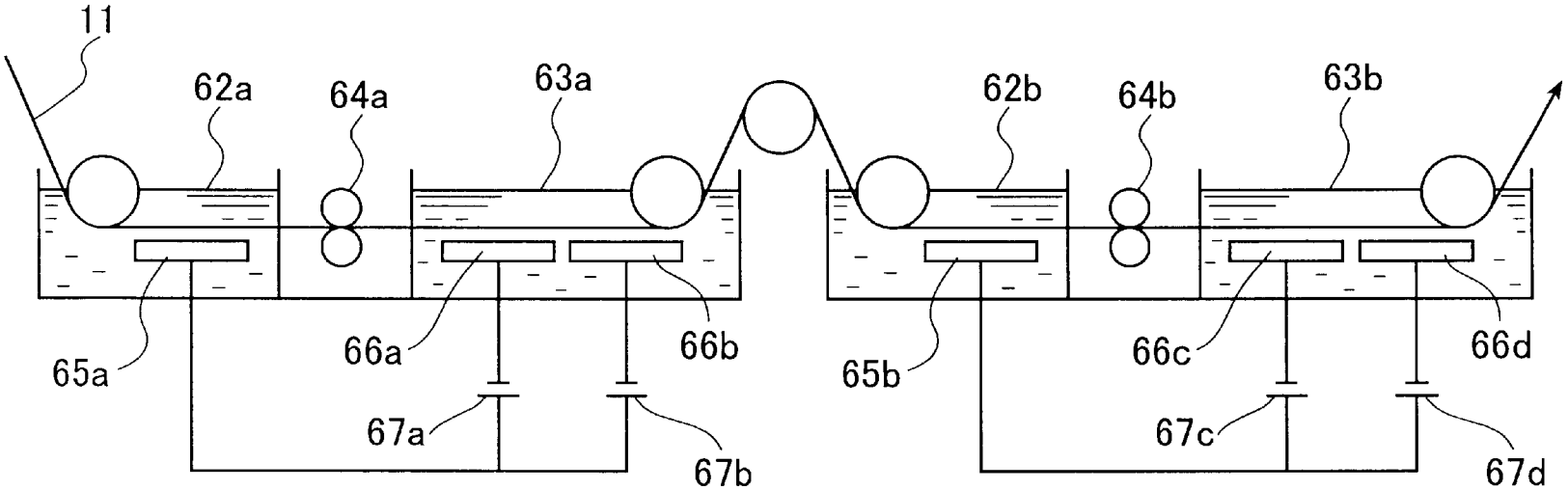
FIG. 4 is a schematic view of an anodizing device based on a two-stage power supply electrolytic method used in anodizing in preparation of a support for a lithographic printing plate of the present invention.

By using the anodizing device (each of first and second electrolytic portions has a length of 6 m, each of first and second power supply units has a length of 3 m, and each of first and second power supply electrodes has a length of 2.4 m) of a two-stage power supply electrolytic method having a structure shown in FIG. 4, anodizing was carried out. Electrolytic supplied for each of the first and second electrolytic portions was sulfuric acid. For each electrolytic, the concentration of sulfuric acid was 170 g/L (containing 0.5 wt % of aluminum ions) and a temperature was 43° C. Then, the aluminum plate was washed by water spraying.

In the above-described anodizing device, currents from power sources 67*a* and 67*b* flow to a first power supply electrode 65*a* provided in a first power supply unit 62*a*, and flow through electrolytic solution to an aluminum plate 11. At a first electrolytic portion 63*a*, an oxide layer is formed on the surface of the aluminum plate 11. Then, the currents are passed through electrolytic electrodes 66*a* and 66*b* provided in the first electrolytic portion 63*a*, and returns to the power sources 67*a* and 67*b*.

On the other hand, currents from power sources 67*c* and 67*d* flow to a second power supply electrode 65*b* provided in a second power supply unit 62*b*, and flow through electrolytic solution to the aluminum plate 11 similarly to the above case. At a second electrolytic portion 63*b*, an oxide layer is formed on the surface of the aluminum plate 11. Then, the currents are passed through electrolytic electrodes 66*c* and 66*d* provided in the second electrolytic portion 63*b*, and returns to the power sources 67*c* and 67*d*.

The quantity of electricity supplied from each of the power sources 67*a* and 67*b* to the first power supply unit 62*a* was equal to that supplied from the power sources 67*c* and 67*d* to the second power supply unit 62*b*. Each of power supply current density on the surface of the oxide layer at the first electrolytic portion 63*a* and the second electrolytic portion 63*b* was about 25 A/dm$^2$. It means that at the second power supply unit 62*b*, electric power was supplied through the oxide layer of 1.35 g/m$^2$ formed by the first electrolytic portion 63*a*. The amount of oxide layer was 2.7 g/m$^2$ at the end.

(h) Alkali Metal Silicate Treatment

Alkali metal silicate treatment (silicate treatment) was carried out by dipping a support for lithographic printing plate, obtained by the anodizing, into a treatment cell with the aqueous solution containing 1 wt % of III-sodium silicate at a temperature of 30° C. for 10 sec. Then, the support was washed by water spraying using well water.

(i) Formation of Intermediate Layer (Undercoat Layer)

Undercoating solution containing a composition described below was coated on the support for a lithographic printing plate treated with the alkali metal silicate, obtained in the foregoing manner, and dried at a temperature of 80° C. for 15 sec, to form a layer. The coating amount after drying was 15 mg/m$^2$.

Undercoating Solution Composition

| | |
|---|---|
| high-molecular compound described below | 0.3 g |
| methanol | 100 g |
| water | 1 g |

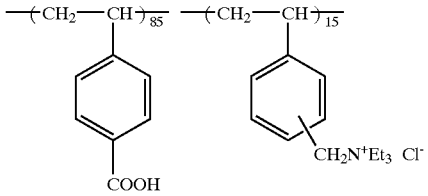

MOLECULAR WEIGHT 28THOUSANDS (j) Formation of Photosensitive Layer

Subsequently, photosensitive layer coating solution 1 having a composition described below was prepared and, the photosensitive layer coating solution 1 was coated over the support for a lithographic printing plate having the undercoat layer formed thereon, so that the amount after drying (the coating amount of photosensitive layer) meets 1.0 g/m$^2$. Then, drying was carried out in order to form a photosensitive layer. In this way, the presensitized plate of Example 1 was obtained.

Composition of Photosensitive Layer Coating Solution 1

| | |
|---|---|
| capric acid | 0.03 g |
| particular copolymer 1 described later | 0.75 g |
| m, p-cresol novolac (m/p ratio = 6/4, weight-average molecular weight 3,500, and containing 0.5 wt % of unreacted cresol) | 0.25 g |
| p-toluenesulfonic acid | 0.003 g |
| tetrahydrophathalic anhydride | 0.03 g |
| cyanine dye A having a structural formula described below | 0.017 g |

CYANINE DYE A

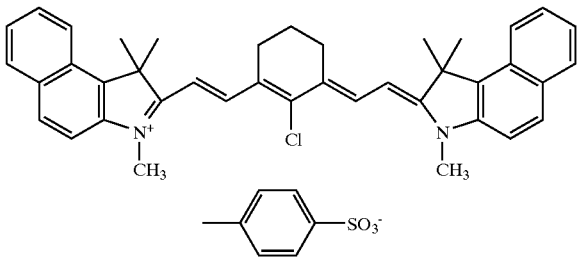

-continued

| | |
|---|---|
| dye prepared by setting a counter ion of Victorian pure blue BOH as 1-napththalene sulfonic acid anion | 0.015 g |
| fluorine-containing surfactant (Megaface F177, by Dainippon Ink and Chemicals Inc.) | 0.05 g |
| γ-butyrolactone | 10 g |
| methyl ethyl ketone | 10 g |
| 1-methoxy-2-propanol | 1 g |

Particular Copolymer 1

Methacrylic acid 31.0 g (0.36 mol), ethyl chloroformate 39.1 g (0.36 mol) and acetonitrile 200 mL were put in a 500 mL-capacity three-neck flask having an agitator, a cooling pipe and a dropping funnel, and a mixture was agitated while beeing cooled in an ice-water bath. Triethylamine 36.4 g (0.36 mol) was dropped to this mixture with the dropping funnel for about 1 hour. After the end of the dropping, the ice-water bath was removed and the mixture was agitated at a room temperature for 30 min.

Then, p-aminobenzene sulfonamide 51.7 g (0.30 mol) was added to the reactive mixture, and agitated for 1 hour while being heated to 70° C. in an oil bath. After the end of the reaction, the mixture was thrown into water 1 L while agitating the water, and the obtained mixture was agitated for 30 min. The mixture was filtered to remove deposition. After this deposition was turned into a slurry in water 500 mL, the slurry was filtered and, by drying an obtained solid, a white solid containing N-(p-aminosulfonyl phenyl) methacrylamide was obtained (yield 46.9 g).

Subsequently, N-(p-aminosulfonyl phenyl) methacrylamide 4.61 g (0.0192 mol), ethyl methacrylate 2.94 g (0.0258 mol), acrylonitrile 0.80 g (0.015 mol) and N,N-dimethyl acetamide 20 g were put in a 20 mL-capacity three-neck flask having an agitator, a cooling pipe and a dropping funnel. Then, a mixture was agitated while being heated to 65° C. in a hot-water bath. "V-65" (by Wako Pure Chemical Industries, Ltd.) 0.15 g was added to the mixture, and the mixture was agitated under a nitrogen gas flow for 2 hours while being maintained at 65° C. To this reactive mixture, the mixture of N-(p-aminosulfonyl phenyl) methacrylamide 4.61 g, ethyl methacrylate 2.94 g, acrylonitrile 0.80 g, N,N-dimethyl acetamide and "V-65" 0.15 g was further dropped with the dropping funnel for 2 hours. After the end of the dropping, the obtained mixture was further agitated at 65° C. for 2 hours. After the end of the reaction, methanol 40 g was added to the mixture, and cooled. The obtained mixture was then thrown into water 2 L while agitating the water. After the mixture was agitated for 30 min, deposition was removed by filtering, and the deposition was dried. Thus, a particular copolymer 1 which is a white solid of 15 g was obtained.

The weight-average molecular weight of the obtained particular copolymer 1 was measured by gel permeation chromatography, and it was 53,000 (polystyrene standard).

Example 2

A presensitized plate of Example 2 was obtained by a method similar to that of Example 1, except for the fact that the (a) mechanical graining treatment was not carried out, and, in the (d) electrochemical graining treatment, the total of the quantity of electricity when the aluminum plate was at the anode side was set to 100 C/dm$^2$.

Example 3

A presensitized plate of Example 3 was obtained by a method similar to that of Example 1, except for the fact that in the (a) mechanical graining treatment, silica sand having an average particle size of 5 μm and a maximum particle size of 50 μm was used as abrasive and, in the (d) electrochemical graining treatment, a temperature of electrolyte was set to 50° C., and the total of the quantity of electricity when the aluminum plate was at the anode side was set to 145 C/dm$^2$.

Example 4

A presensitized plate of Example 4 was obtained by a method similar to that of Example 1, except for the fact that the (a) mechanical graining treatment was not carried out, and the steps of the (d) electrochemical graining treatment and (e) alkali etching treatment were repeated twice under different conditions as described later.

The first round of electrochemical graining treatment was carried out by a method similar to the (d) of Example 1, except for the fact that a temperature of electrolyte was set to 50° C., TP was set to 0.8 msec., a frequency of an alternating voltage was set to 0.3 Hz, and a current density was set to 25 A/dm$^2$ at a peak value of a current. Then, the first round of alkali etching treatment was carried out by a method similar to the (e) of Example 1 except for a temperature of 70° C. Subsequently, the second round of electrochemical graining treatment was performed by a method similar to the (d) of Example 1, and the second round of alkali etching treatment was carried out by a method similar to the (e) of Example 1.

Comparative Example 1

A presensitized plate of Comparative Example 1 was obtained by a method similar to that of Example 1, except for the fact that the (d) electrochemical graining treatment was not carried out.

Comparative Example 2

A presensitized plate of Comparative Example 2 was obtained by a method similar to that of Example 1, except for the fact that in the (d) electrochemical graining treatment, a temperature of electrolyte was set to 40° C., and the total of the quantity of electricity when the aluminum plate was at the anode side was set to 270 C/dm$^2$.

Comparative Example 3

A presensitized plate of Comparative Example 3 was obtained by a method similar to that of Example 2, except for the fact that in the (d) electrochemical graining treatment, a temperature of electrolyte was set to 40° C., and the total of the quantity of electricity when the aluminum plate was at the anode side was set to 270 C/dm$^2$.

Comparative Example 4

A presensitized plate was obtained by a method similar to that of Example 1, except for the fact that in the (a) mechanical graining treatment, pumice composed of volcanic ash having an average particle size of 40 μm and a maximum particle size of 200 μm was used as abrasive and, in the (d) electrochemical graining treatment, the total of the quantity of electricity when the aluminum plate was at the anode side was set to 50 C/dm$^2$.

1–2. Ratio of Real Area of Surface to Apparent Area of Surface in Supports for Lithographic Printing Plates For the support for the lithographic printing plate after the alkali metal silicate treatment, which was obtained in the process of making the presensitized plate, a ratio of a real area of the surface to an apparent area thereof was measured in the following manner.

A surface shape of the support for the lithographic printing plate was measured by using an atomic force microscope (AFM) under conditions of resolution of a horizontal direction (X, Y) set to 0.1 μm, and a measuring area set to 100 μm-square. A surface area obtained by an approximate three-point method was set as a real area, an upper projected area was set as an apparent area. Then, the real area was divided by the apparent area, thereby obtaining a ratio of the real area of the surface to the apparent area of the surface.

Table 1 shows a result. In Table 1, a ratio of a real area of a surface to an apparent area of a surface is represented as "Surface real area/surface apparent area".

1–3. Measurement of Average Diameter of Pits and Ratio of Pit Apparent Area to Surface Apparent Area in Supports for Lithographic Printing Plates The surface of the support for the lithographic printing plate was subjected to SEM photographing of 10000 magnification from a direction perpendicular to the support by using a scanning electron microscope (SEM). In the SEM photograph, diameters of 30 pits were measured to obtain an average diameter of pits. A transparent film was superposed on the SEM photograph, a flat portion having no pits formed was copied onto the transparent film with a pen, and an area ratio of the portion copied on the transparent film was obtained by an image analysis device. Accordingly, a ratio of a pit apparent area to a surface apparent area was calculated.

Table 1 shows a result. In Table 1, a ratio of a pit apparent area to a surface apparent area is represented as "Pit apparent area/surface apparent area".

1–4. Measurement of Wavelength of Large Undulation on Surfaces of Supports for Lithographic Printing Plates Fractured sections of the anodized layer and the photosensitive layer exposed by bending the presensitized plate by 180° were observed by magnification of 5000 using a T-20 scanning electron microscope manufactured by JEOL. For a concave portion having an opening diameter of 2 μm or more on the surface of the support, a distance between both ends thereof was measured to set a wavelength of large undulation, and an average wavelength among concave portion of 20 points were obtained.

Table 1 shows a result. Note that, in Table 1, "–" represents no presence of concave portions of relevant wavelengths.

1–5. Evaluation of Damage Resistance of Presensitized Plates

For the presensitized plate made in the foregoing manner, evaluation was made as to damage resistance thereof.

An interleaving sheet was placed on the photosensitive layer surface of the presensitized plate, put corrugated by fiberboard between top and bottom thereof, and left under an environment of 25° C. and 50% RH for 3 days. Then, the photosensitive layer surface of the presensitized plate was rubbed with a cotton glove 5 times back and forth, and developed by an automatic developing machine 900NP using PS plate developer DT-1 manufactured by Fuji Photo Film Co., Ltd. under standard use conditions. A level of clear of the rubbed portion caused by scratching was visually observed, and evaluated.

A mark ○ represents no changes at all from before development, X almost no visibility of photosensitive layer color caused by substantial exposure of the support and ○Δ, Δ, and ΔX intermediate levels thereof.

Table 1 shows a result.

1–6. Evaluation of Press Life of Lithographic Printing Plates

The presensitized plate was subjected to image-exposure by using TrendSetter 3244 manufactured by CREO Inc., in such a way as to set the quantity of plate surface energy to 141 mJ/cm$^2$. Then, the presensitized plate was developed by the automatic developing machine 900NP using the PS plate developer DT-1 manufactured by Fuji Photo Film Co., Ltd. under standard conditions.

The lithographic printing plate thus obtained was then printed on woodfree paper by a Lithron printer manufactured by Komori Corporation using ink of DIC-GEOS (N) black manufactured by Dainippon Ink And Chemicals, Inc. and fountain solution containing 1% of etching liquid EU-3 manufactured by Fuji Photo Film Co., Ltd., and 10% of IPA. Then, a press life thereof was evaluated depending on the number of printed sheets when a start of a reduction in density of a solid image was visually recognized.

Table 1 shows a result.

It can be understood that the presensitized plates of the present invention using the supports for the lithographic printing plates according to the first aspect of the invention had damage resistance, and were excellent in press life (Examples 1 to 4). Especially, it can be understood that when the surfaces had the large-medium-small complex grained structure comprising 3 different frequency undulations, a wavelength of large undulation was 3 to 10 μm, medium undulation was a pit, and small undulation was a micro grained structure of pits (Examples 1, 3 and 4), damage resistance and press life thereof were well balanced.

On the other hand, when the ratio of a real area of the surface of the support for the lithographic plate to an apparent area was too small (Comparative Example 1), a press life was deteriorated, peeling occurred between the photosensitive layer and the support, the presensitized plate was easily damaged. When the ratio of a real area of the surface of the support for the lithographic printing plate to an apparent area was too large (Comparative Example 2), the photosensitive layer was easily damaged. When the average diameter of pits was too large (Comparative Example 3), and the ratio of a pit apparent area to a surface apparent area was too small (Comparative Example 4), the presensitized plates were easily damaged.

TABLE 1

| | Surface real area/ surface apparent area | Average diameter (μm) of pits | Pit apparent area/ surface apparent area | Wavelength of large undulation (μm) | Damage resistance | Press life |
|---|---|---|---|---|---|---|
| Examples | | | | | | |
| 1 | 1.48 | 0.48 | 95 | 9.3 | ○Δ | 80000 sheets |
| 2 | 1.36 | 0.53 | 93 | — | ○ | 60000 sheets |
| 3 | 1.53 | 0.68 | 99 | 8.5 | ○Δ | 100000 sheets |

TABLE 1-continued

| | Surface real area/ surface apparent area | Average diameter (μm) of pits | Pit apparent area/ surface apparent area | Wavelength of large undulation (μm) | Damage resistance | Press life |
|---|---|---|---|---|---|---|
| 4 | 1.49 | 0.47 | 94 | 8.0 | ○Δ | 100000 sheets |
| Comparative Examples | | | | | | |
| 1 | 1.11 | 3.30 | 100 | 9.3 | X | 10000 sheets |
| 2 | 1.89 | 1.19 | 92 | 10.5 | ΔX | 60000 sheets |
| 3 | 1.60 | 1.27 | 96 | — | Δ | 80000 sheets |
| 4 | 1.75 | 0.51 | 81 | 14.4 | ΔX | 20000 sheets |

Examples of Second Aspect of the Invention

2–1. Preparation of Presensitized Plates

Examples 5 to 8 and Comparative Examples 5 to 7

A presensitized plate was obtained by a method similar to that of Example 1, except for the fact that in the (a) mechanical graining treatment, a type of abrasive, an average particle size of abrasive and a rotating speed of brushes; in the (d) electrochemical graining treatment, a type of electrolyte, concentration of electrolyte, a temperature of electrolyte, a current density and the quantity of electricity when the aluminum plate was at the anode side; and in the (e) alkali etching treatment, the quantity of dissolved aluminum were set as shown on Table 2. However, in the (a) mechanical graining treatment, a maximum particle size of abrasive varied depending on average particle sizes. Moreover, in the (d) electrochemical graining treatment, aluminum ion concentration of the electrolyte was set to 4.5 g/L and, in the (g) anodizing treatment, current densities of first electrolytic portion 63*a* and second electrolytic portion 63*b* were both set to about 30 A/dm$^2$.

2–2. Measurement of Average Diameter of Pits (Grained Structure with Medium Undulation) of Supports for Lithographic Printing Plates An average diameter of pits (grained structure with medium undulation) of the support for the lithographic printing plate was measured by a method similar to that of 1–3.

Table 2 shows a result.

2–3. Measurement of Wavelength of Grained Structure with Large Undulation of Surfaces of Supports for Lithographic Printing Plates The photosensitive layer of the presensitized plate was dissolved and removed by y-butyrolactone. Then, the exposed surface was observed from a direction of 30° C. from a normal direction by magnification of 2000 using the T-20 scanning electron microscope manufactured by JEOL, and wavelength components larger than 2 μm were measured at 30 points in a horizontal direction. Accordingly, an average wavelength was obtained.

Table 2 shows a result.

2–4. Evaluation of Damage Resistance of Presensitized Plates

Evaluation was made of damage resistance of presensitized plate by a method similar to that of 1–5.

Table 2 shows a result.

2–5. Evaluation of Press Life of Lithographic Printing Plates

Evaluation was made of press life of the lithographic printing plate by a method similar to that of 1–6.

Table 2 shows a result.

It can be understood that the presensitized plates of the present invention using the supports for the lithographic printing plates according to the second aspect of the invention had damage resistance, and were excellent in press life (Examples 5 to 8).

On the other hand, when a wavelength of large undulation of the surface of the support for the lithographic plate was too long (Comparative Example 5), peeling occurred between the photosensitive layer and the support, damaged easily, and a press life was deteriorate. Moreover when electrochemical graining treatment using nitric acid as electrolyte for pits constituting a grained structure with medium undulation was carried out (Comparative Example 6), asperities were enlarged on the surface of the photosensitive layer, and easily damaged. Furthermore, when an average diameter of pits constituting a grained structure with medium undulation was too large (Comparative Example 7), a press life was inferior.

TABLE 2

| | Mechanical graining treatment | | |
|---|---|---|---|
| | Type of abrasive | Average particle size (μm) of abrasive | Rotating speed of brushes (rpm) |
| Example 5 | silica sand | 25 | 200 |
| Example 6 | silica sand | 8 | 200 |
| Example 7 | silica sand | 5 | 200 |
| Example 8 | pumice | 40 | 150 |
| Comparative Example 5 | pumice | 40 | 250 |
| Comparative Example 6 | silica sand | 25 | 200 |
| Comparative Example 7 | silica sand | 25 | 200 |

| | Electrochemical graining treatment | | | | |
|---|---|---|---|---|---|
| | Type of electrolyte | Concentration (wt %) of electrolyte | Temperature (° C.) of electrolyte | Current density (A/dm$^2$) | Quantity of electricity (C/dm$^2$) when the aluminum plate was at the anode side |
| Example 5 | Hydrochloric acid | 7.5 | 35 | 25 | 50 |
| Example 6 | Hydrochloric acid | 7.5 | 35 | 25 | 80 |
| Example 7 | Hydrochloric | 7.5 | 35 | 25 | 50 |

TABLE 2-continued

| | | | | | |
|---|---|---|---|---|---|
| | acid | | | | |
| Example 8 | Hydrochloric acid | 7.5 | 35 | 25 | 50 |
| Comparative Example 5 | Hydrochloric acid | 10 | 45 | 20 | 200 |
| Comparative Example 6 | Nitric acid | 9.0 | 40 | 30 | 270 |
| Comparative Example 7 | Hydrochloric acid | 7.5 | 35 | 25 | 50 |

| | Alkali etching treatment Quantity of dissolved aluminium ($g/m^2$) | Wavelenghth ($\mu m$) of large undulation | Average diameter ($\mu m$) of pits | Damage resistance | Press life (Ten thousands sheets) |
|---|---|---|---|---|---|
| Example 5 | 0.2 | 8 | 0.1 | ○Δ | 8 |
| Example 6 | 0.1 | 3 | 0.1 | ○ | 6 |
| Example 7 | 0.5 | 2 | 0.1 | ○ | 10 |
| Example 8 | 0.2 | 9 | 0.1 | ○Δ | 10 |
| Comparative Example 5 | 0.2 | 13 | 0.2 | ΔX | 3 |
| Comparative Example 6 | 0.2 | 8 | 1.3 | X | 10 |
| Comparative Example 7 | 1.0 | 8 | 0.6 | Δ | 2 |

Examples of Third Aspect of the Invention

3–1. Preparation of Presensitized Plates

Example 9

A presensitized plate of Example 9 was obtained by a method similar to that of Example 1, except for the fact that a Cu content of an aluminum plate used was set to 0.005 wt %; in the (d) electrochemical graining treatment, concentration of electrolyte was set to 10.5 g/L, a temperature of electrolyte was set to 20° C. and TP of an alternating current was set to 0.8 msec.; in the (g) anodizing treatment, sulfuric acid concentration in the electrolyte was set to 50 g/L, a temperature of electrolyte was set to 20° C. and current densities of first electrolytic portion 63*a* and second electrolytic portion 63*b* were both set to about 30 $A/dm^2$.

Example 10

A presensitized plate of Example 10 was obtained by a method similar to that of Example 9, except for the fact that in the (g) anodizing treatment, ammonium borate aqueous solution of 4 wt % was used as electrolyte and low-current electrolysis was realized by setting current densities of first electrolytic portion 63*a* and second electrolytic portion 63*b* both to about 0.1 $A/dm^2$.

Example 11

A presensitized plate of Example 11 was obtained by a method similar to that of Example 9, except for the fact that in the (d) electrochemical graining treatment, hydrochloric acid 7.5 g/L aqueous solution (containing 5 g/L of aluminum ion) was used as electrolyte, current density was set to 25 $A/dm^2$ at a current peak value, and the total of the quantity of electricity when the aluminum plate was at the anode side was set to 50 $C/dm^2$.

Example 12

A presensitized plate of Example 12 was obtained by a method similar to that of Example 9, except for the fact that a Cu content of an aluminum plate used was set to 0.17 wt %.

Example 13

A presensitized plate of Example 13 was obtained by a method similar to that of Example 9, except for the fact that sealing treatment was carried out by using pressurized steam after the (g) anodizing treatment and before the (h) treatment with alkali metal silicate in a manner described below.

The sealing treatment was carried out by processing for 10 sec., in a saturated steam chamber at 100° C., and under 1 atm.

Example 14

A presensitized plate of Example 14 was obtained by a method similar to that of Example 9, except for the fact that in the (d) electrochemical graining treatment, nitric acid 10 g/L aqueous solution (containing 5 g/L of aluminum ion and 0.007 wt % of ammonium ion) was used as electrolyte, temperature of the electrolyte was set to 80° C., TP was set to 0 msec., and the total of the quantity of electricity when the aluminum plate was at the anode side was set to 130 $C/dm^2$.

Comparative Example 8

A presensitized plate of Comparative Example 8 was obtained by a method similar to that of Example 9, except for the fact that the (a) mechanical graining treatment was not carried out.

Comparative Example 9

A presensitized plate of Comparative Example 9 was obtained by a method similar to that of Example 9, except for the fact that in the (d) electrochemical graining treatment, frequency of an alternating voltage used was set to 3 Hz, temperature of electrolyte was set to 35° C., and the total of the quantity of electricity when the aluminum plate was at the anode side was set to 400 $C/dm^2$.

Comparative Example 10

A presensitized plate of Comparative Example 10 was obtained by a method similar to Example 9, except for the fact that in the (g) anodizing treatment, sulfuric acid concentration in electrolyte was set to 250 g/L (containing 0.5 wt % of aluminum ion), and temperature of the electrolyte was set to 50° C.

Comparative Example 11

A presensitized plate of Comparative Example 11 was obtained by a method similar to that of Example 9, except for the fact that in the (g) anodizing treatment, phosphoric acid aqueous solution of 50 g/L was used as electrolyte, and current densities of first electrolytic portion 63*a* and second electrolytic portion 63*b* were both set to 20 $A/dm^2$.

Comparative Example 12

A presensitized plate of Comparative Example 12 was obtained by a method similar to that of Example 9, except for the fact that in the (e) alkali etching treatment, quantity of dissolved aluminum plate was set to 1.0 $g/m^2$ by controlling a liquid temperature.

3–2. Measurement of Average Diameter of Pits (Grained Structure with Medium Undulation) of Supports for Lithographic Printing Plates, and Observation of Fine Asperities (Grained Structure with Small Undulation) Inside Pits An average diameter of pits (grained structure with small undulation) of the support for the lithographic printing plate was measured by a method similar to that of 1–3. Also, Observation in SEM Photograph was Made as to Whether Fine Asperities Inside Pits Exist or Not Table 3 shows a result.

3–3. Measurement of Wavelength of Grained Structure with Large Undulation of Surfaces of Supports for Lithographic Printing Plates A wavelength of a grained structure with large undulation on the surface of the support for the lithographic printing plate was carried out by methods similar to that of 2–3.

Table 3 shows a result. In Table 3, "–" represents no presence of concave portions of a relevant wavelength.

3–4. Measurement of Average Pore Diameter and Average Pore Density of Micropores The photosensitive layer of the presensitized plate was dissolved and removed with γ-butyrolactone, and subjected to ultrasonic cleaning in γ-butyrolactone for 30 min. Then, the exposed surface was subjected to SEM photographing by magnification of 150000 by FE-SEM (S-900 by Hitachi, Ltd.) without being vapor-deposited. In the SEM photograph, 3 visual fields were observed, pore diameters of 100 pores were measured, and an average value among them was set as an average pore diameter.

From the SEM photograph, 3 visual fields of a 300 nm-square portion were extracted for, and the number of pores therein was counted to obtain an average value of a pore density. Accordingly, an average pore density was set.

Table 3 shows a result.

3–5. Evaluation of Damage Resistance of Presensitized Plates

Evaluation of damage resistance of the presensitized plate was made by a method similar to that of 1–5.

Table 3 shows a result.

3–6. Evaluation of Sensitivity of Presensitized Plates

The presensitized plate was subjected to full-surface exposure by changing the quantity of plate surface energy using TrendSetter 3244 by CREO Inc. Then, it was developed by the automatic developing machine 900 NP using the PS plate developer DT-1 by Fuji Photo Film Co., Ltd. under standard condition. Sensitivity thereof was evaluated by the quantity of plate surface energy when complete removal of the photosensitive layer was visually observed.

Table 3 shows a result.

It can be understood that the presensitized plates of the present invention using the supports for the lithographic printing plates according to the third aspect of the present invention had damage resistance, and were excellent in sensitivity (Examples 9 to 14). Especially, when Cu content in the aluminum plates used were 0.005 wt % (Examples 9 to 11, 13 and 14), an average diameter of pits constituting a grained structure with medium undulation tended to be small and uniform, thus, better damage resistance was provided.

On the other hand, although in Comparative Examples 8 to 12, the surfaces of the photosensitive layers had less asperity and were made smooth as in the case of Examples 9 to 14, the following drawbacks were present. That is, when the surface of the support for the lithographic printing plate had no grained structures with large undulation (Comparative Example 8), and when a wavelength of large undulation was too long (Comparative Example 9), peeling easily occurred between the photosensitive layer and the support, and easily damaged. When an average pore density of micropores on the anodized layer was too high (Comparative Example 10), and when an average pore diameter was too large (Comparative Example 11), sensitivity was low. Moreover, when no micro grained structures were inside pits (Comparative Example 12), peeling occurred between the photosensitive layer and the support, and damaged easily.

TABLE 3

| | Wavelength (μm) of large undulation | Average diameter (μm) of pits | Presence of micro grained structure |
|---|---|---|---|
| Example 9 | 8.0 | 0.75 | Yes |
| Example 10 | 8.0 | 0.75 | Yes |
| Example 11 | 8.0 | 0.15 | Yes |
| Example 12 | 8.0 | 0.95 | Yes |
| Example 13 | 8.0 | 0.75 | Yes |
| Example 14 | 8.0 | 0.50 | Yes |
| Comparative Example 8 | — | 0.75 | Yes |
| Comparative Example 9 | 15 | 0.75 | Yes |
| Comparative Example 10 | 8.0 | 0.75 | Yes |
| Comparative Example 11 | 8.0 | 0.75 | Yes |
| Comparative Example 12 | 8.0 | 0.75 | No |

| | Micropore | | | |
|---|---|---|---|---|
| | Average pore diameter (nm) | Average pore density (pieces/μm²) | Damage resistance | Sensitivity (mJ/cm²) |
| Example 9 | 12 | 380 | ○Δ | 60 |
| Example 10 | 0 | 0 | ○Δ | 50 |
| Example 11 | 12 | 380 | ○ | 70 |
| Example 12 | 12 | 380 | Δ | 60 |
| Example 13 | 5 | 280 | ○Δ | 60 |
| Example 14 | 12 | 380 | ○ | 60 |
| Comparative Example 8 | 12 | 380 | ΔX | 55 |
| Comparative Example 9 | 12 | 380 | ΔX | 80 |
| Comparative Example 10 | 12 | 750 | ○Δ | 140 or more |
| Comparative Example 11 | 83 | 50 | ○Δ | 140 or more |
| Comparative Example 12 | 12 | 380 | ΔX | 60 |

Examples of Surface Shape of Photosensitive Layer

4–1. Preparation of Presensitized Plates

Example 15

A presensitized plate of Example 15 was obtained by a method similar to that of Example 1, except for the fact that a Cu content in the aluminum plate used was set to 0.017 wt %; in the (a) mechanical graining treatment, an average particle size of abrasive was set to 20 μm, and a maximum particle size was set to 100 μm; in the (b) alkali etching treatment, the quantity of dissolved aluminum was set to 10 g/m²; and in the (d) electrochemical graining treatment, the total of the quantity of electricity when the aluminum plate was at the anode side was set to 130 C/dm².

Example 16

A presensitized plate of Example 16 was obtained by a method similar to that of Example 15, except for the fact that the (a) mechanism graining treatment was not carried out, and in the (d) electrochemical graining treatment, the total of the quantity of electricity when the aluminum plate was at the anode side was set to 100 C/dm².

Example 17

A presensitized plate of Example 17 was obtained by a method similar to that of Example 16, except for the fact that in the (d) electrochemical graining treatment, nitric acid 11 g/L aqueous solution (containing 5 g/L of aluminum ion, and 0.007 wt % of ammonium ion) was used as electrolyte, temperature of the electrolyte was set to 50° C., and TP of an alternating power supply waveform of an alternating voltage was set to 0.8 msec., and the total of the quantity of electricity when the aluminum plate was at the anode side was set to 240 C/dm$^2$; and in the (e) alkali etching treatment, quantity of dissolved aluminum plate was set to 4 g/m$^2$.

Example 18

A presensitized plate of Example 18 was obtained by a method similar to that of Example 15, except for the fact that in the (a) mechanical graining treatment, a pressed load was set to 5 kW, and the (d) electrochemical graining treatment and (e) alkali etching treatment were not carried out.

4–2. Measurement of Average Depth of Concave Portion on Surfaces of Supports for Lithographic Printing Plates Fractured sections of the anodized layer and the photosensitive layer exposed by bending the presensitized plate by 180° were observed by magnification of 20000 using the T-20 scanning electron microscope by JEOL. Therefore, an average depth among concave portions of medium undulation having wavelength of 0.05 to 2.0 μm on the surface of the support was measured. The measurement of the average depth of the concave portions was carried out by setting longest distances between lines connecting both ends of respective concave portions looked bowl-shaped on the support section and any points on curves of the concave portions as depths of the concave portions, measuring depths of concave portions of 20 points, and obtaining an average among them.

An average depth among concave portions with large undulation having wavelength of 3 to 10 μm was also measured in a manner similar to that of the above-described case, except for setting of observation magnification to 10000.

Table 4 shows a result. In Table 4, "–" represents no presence of concave portions of relevant wavelengths.

4–3. Evaluation of Damage Resistance of Presensitized Plates

Evaluation of damage resistance of the presensitized plate was made by a method similar to that of 1–5.

Table 4 shows a result.

4–4. Measurement of Average Gradient θa of Surface of Photosensitive Layers

An non-rubbed portion of the sample used for the evaluation of the damage resistance was cut out by a size of 50 mm×100 mm, and an average gradient θa of the surface of the photosensitive layer was measured.

For the measurement of the average gradient θa, the support for the lithographic printing plate was scanned in rolling and perpendicular directions to obtain a sectional curve by using a stylus type surface roughness gauge (Surfcom 575 manufactured by Tokyo Seimitsu Co., Ltd., a sensing pin: 1 μm R) under conditions of measuring length 3 mm, a scanning speed 0.03 mm/s, and a cutoff value 0.08 mm, and calculation was made by using the equation (1). In this case, a 2 CR filter was used, V-MAG was 20000, and for gradient correction, horizontal (FLAT-ML) was selected.

The measurement of the average gradient θa was carried out 7 times, and an average value of 5 measurements excluding maximum and minimum values was set as an average value θa.

Table 4 shows a result.

It can be understood that the presensitized plates of the present invention having an average gradient of 5° or lower on the surfaces of the photosensitive layers had damage resistance (Examples 15 to 18).

In the support for the lithographic plate used in each of Examples 15 to 18, a ratio of a real area of the surface to a apparent area of the surface was larger by 1.3 to 1.8 times, pits having an average diameter of 0.3 to 1.0 μm and micro grained structures inside were present on the surface, and a ratio of the pit apparent area to the surface apparent area was 90% or more.

TABLE 4

| | | Average depth [μm] | | |
|---|---|---|---|---|
| | θa [°] | Concave portion of large undulation | Concave portion of medium undulation | Damage resistance |
| Example 15 | 3.5 | 0.52 | 0.20 | ○Δ |
| Example 16 | 1.4 | — | 0.17 | ○Δ |
| Example 17 | 2.4 | — | 0.26 | Δ |
| Example 18 | 2.0 | 0.21 | — | Δ |

INDUSTRIAL APPLICABILITY

The presensitized plate of the present invention has damage resistance, and is high in sensitivity, easy to be handled in conventional operation, and is excellent in press life. The support for the lithographic printing plate of the present invention is suitably used for the presensitized plate of the present invention.

What is claimed is:

1. A support for a lithographic printing plate obtained by performing graining treatment, alkali etching treatment and anodizing treatment on an aluminum plate, wherein a ratio of a real area of a surface thereof to an apparent area of the surface set larger by 1.3 to 1.8 times, comprising a pit having an average diameter of 0.3 to 1.0 μm and a micro grained structure inside on the surface, wherein a ratio of an apparent area of the pits to the apparent area of the surface is 90% or more.

2. A support for a lithographic printing plate according to claim 1, wherein the surface has a large-medium-small complex grained structure of 3 different frequency undulations, a wavelength of large undulation is 3 to 10 μm, medium undulation is the pit, and small undulation is the micro grained structure of the pit.

3. A presensitized plate comprising the support for a lithographic printing plate according to claim 2 and a photosensitive layer that can become alkali-soluble by heating provided on the support.

4. A presensitized plate comprising the support for a lithographic printing plate according to claim 1 and a photosensitive layer that can become alkali-soluble by heating provided on the support.

5. A support for a lithographic printing plate obtained by performing graining treatment and anodizing treatment on an aluminum plate, comprising a grained structure with large undulation having a wavelength of 2 to 10 μm and a grained structure with medium undulation consisting of pits, each having an average diameter of 0.05 to 0.5 μm on a surface thereof, wherein the grained structure with medium undulation is obtained by performing electrochemical graining treatment by alternating current electrolysis using electrolyte containing hydrochloric acid at 100 C/dm$^2$ or lower of a quantity of electricity when the aluminum plate was at an anode side, and chemical etching treatment to set a quantity of dissolved aluminum to 0.05 to 0.5 g/m$^2$.

6. A presensitized plate comprising the support for a lithographic printing plate according to claim 5 and a photosensitive layer that can become alkali-soluble by heating provided on the support.

7. A support for a lithographic printing plate obtained by performing graining treatment, alkali etching treatment and anodizing treatment on an aluminum plate, comprising a grained structure with large undulation having a wavelength of 2 to 10 $\mu$m, a grained structure with medium undulation consisting of pits, each having an average diameter of 0.1 to 1.5 $\mu$m and a grained structure with small undulation consisting of a micro grained structure inside a pit on a surface thereof, and with regard to an anodized layer formed by the anodizing treatment, an average pore diameter of micropores is 0 to 15 nm, and an average pore density is 0 to 400 pieces/$\mu$m$^2$.

8. A presensitized plate comprising the support for a lithographic printing plate according to claim 7 and a photosensitive layer that can become alkali-soluble by heating provided on the support.

* * * * *